US010761440B2

(12) United States Patent
Tsurumi et al.

(10) Patent No.: US 10,761,440 B2
(45) **Date of Patent: *Sep. 1, 2020**

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Hiroki Tsurumi, Osaka (JP); Eiichi Miyamoto, Osaka (JP); Jun Azuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/345,495

(22) PCT Filed: Aug. 24, 2017

(86) PCT No.: PCT/JP2017/030363
§ 371 (c)(1),
(2) Date: Apr. 26, 2019

(87) PCT Pub. No.: WO2018/079038
PCT Pub. Date: May 3, 2018

(65) Prior Publication Data

US 2019/0310562 A1 Oct. 10, 2019

(30) Foreign Application Priority Data

Oct. 28, 2016 (JP) ..... 2016-211391

(51) Int. Cl.
*G03G 5/06* (2006.01)
*G03G 5/05* (2006.01)

(52) U.S. Cl.
CPC ..... *G03G 5/056* (2013.01); *G03G 5/0605* (2013.01); *G03G 5/0609* (2013.01);
(Continued)

(58) Field of Classification Search
CPC .... G03G 5/056; G03G 5/0614; G03G 5/0605; G03G 5/0609; G03G 5/0651; G03G 5/06147
See application file for complete search history.

(56) References Cited

U.S. PATENT DOCUMENTS 10,191,397 B2 * 1/2019 Maruo ..... G03G 5/056
10,295,918 B2 * 5/2019 Shimizu ..... G03G 5/0596
(Continued)

FOREIGN PATENT DOCUMENTS

JP H10-288845 A 10/1998
JP 2014092594 A * 5/2014

OTHER PUBLICATIONS

Diamond, Arthur S. (ed). Handbook of Imaging Materials. New York: Marcel-Dekker, Inc. (2001) pp. 145-164.*
(Continued)

*Primary Examiner* — Christopher D Rodee
(74) *Attorney, Agent, or Firm* — Studebaker & Brackett PC

(57) ABSTRACT

A photosensitive member (1) includes a conductive substrate (2) and a photosensitive layer (3). The photosensitive layer is a single-layer photosensitive layer (3*c*). The photosensitive layer contains a charge generating material, a hole transport material, an electron transport material, and a
(Continued)

binder resin. The hole transport material includes a triphenylamine derivative represented by general formula (HT). The electron transport material includes a compound represented by general formula (ET1), (ET2), (ET3), (ET4), or (ET5). The binder resin includes a polyarylate resin represented by general formula (1)

(1)

(HTM)

(ETM1)

(ETM2)

-continued (ETM3)

(ETM4)

(ETM5)

16 Claims, 6 Drawing Sheets

(52) U.S. Cl.
CPC ..... *G03G 5/0614* (2013.01); *G03G 5/0651* (2013.01); *G03G 5/0672* (2013.01); *G03G 5/0677* (2013.01); *G03G 5/06147* (2020.05)

(56) References Cited

U.S. PATENT DOCUMENTS

| | | | | |
|---|---|---|---|---|
| 10,359,713 | B2 * | 7/2019 | Shimizu | G03G 5/0618 |
| 2004/0101771 | A1 * | 5/2004 | Azuma | G03G 5/05 430/58.85 |
| 2006/0183044 | A1 * | 8/2006 | Kim | C07D 471/06 430/78 |
| 2008/0305418 | A1 * | 12/2008 | Hamasaki | G03G 5/0564 430/78 |
| 2014/0154619 | A1 * | 6/2014 | Shimizu | G03G 5/0609 430/56 |
| 2017/0307989 | A1 * | 10/2017 | Azuma | G03G 5/0564 |
| 2018/0046100 | A1 * | 2/2018 | Maruo | G03G 5/056 |
| 2018/0046101 | A1 * | 2/2018 | Shimizu | G03G 5/0596 |
| 2018/0299797 | A1 * | 10/2018 | Shimizu | G03G 5/0618 |
| 2019/0025721 | A1 * | 1/2019 | Shimizu | G03G 5/0618 |

OTHER PUBLICATIONS

English language machine translation of JP 2014-092594 (Year: 2014).*

* cited by examiner

ELECTROPHOTOGRAPHIC PHOTOSENSITIVE MEMBER, PROCESS CARTRIDGE, AND IMAGE FORMING APPARATUS

TECHNICAL FIELD

The present invention relates to an electrophotographic photosensitive member, a process cartridge, and an image forming apparatus.

BACKGROUND ART

An electrophotographic image forming apparatus (for example, a printer or a multifunction peripheral) includes an electrophotographic photosensitive member as an image bearing member. The electrophotographic photosensitive member includes a photosensitive layer. Examples of the electrophotographic photosensitive member include a single-layer electrophotographic photosensitive member and a multi-layer electrophotographic photosensitive member. The single-layer electrophotographic photosensitive member includes a photosensitive layer having a charge generating function and a charge transporting function. The multi-layer electrophotographic photosensitive member includes a photosensitive layer including a charge generating layer having a charge generating function and a charge transport layer having a charge transporting function.

Patent Literature 1 discloses a polyarylate resin including a repeating unit represented by chemical formula (E-1) shown below. An electrophotographic photosensitive member containing the polyarylate resin is also disclosed.

SUMMARY OF INVENTION

Technical Problem

However, occurrence of transfer memory cannot be sufficiently inhibited through the electrophotographic photosensitive member disclosed in Patent Literature 1.

The present invention has been made in view of the foregoing and has its object of providing an electrophotographic photosensitive member through which occurrence of transfer memory is inhibited. Another object of the present invention is to provide a process cartridge and an image forming apparatus through which occurrence of an image defect is inhibited.

Solution to Problem

An electrophotographic photosensitive member according to the present invention includes a conductive substrate and a photosensitive layer. The photosensitive layer is a single-layer photosensitive layer. The photosensitive layer contains a charge generating material, a hole transport material, an electron transport material, and a binder resin. The hole transport material includes a triphenylamine derivative. The triphenylamine derivative is represented by general formula (HT) shown below. The electron transport material includes a compound represented by general formula (ET1), general formula (ET2), general formula (ET3), general formula (ET4), or general formula (ET5) shown below. The binder resin includes a polyarylate resin. The polyarylate resin is represented by general formula (1) shown below.

(E-1)

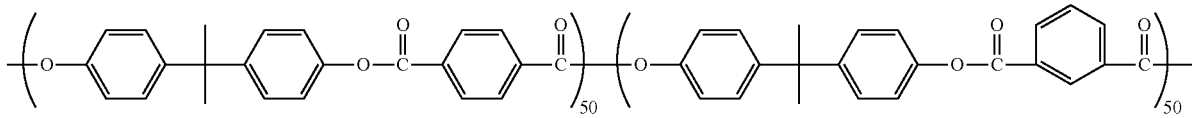

(1)

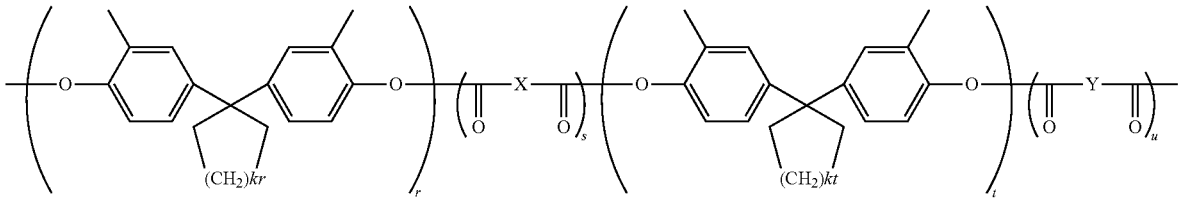

In general formula (1), r and s represent an integer of at least 0 and no greater than 49. t and u represent an integer of at least 1 and no greater than 50. r+s+t+u=100. r+t=s+u. r and t may be the same as or different from each other. s and u may be the same as or different from each other. kr represents 2 or 3. kt represents 2 or 3. X and Y each represent, independently of one another, a divalent group

CITATION LIST

Patent Literature

[Patent Literature 1]
Japanese Patent Application Laid-Open Publication No. 10-288845 represented by chemical formula (2A), chemical formula (2B), chemical formula (2C), chemical formula (2D), chemical formula (2E), chemical formula (2F), or chemical formula (2G) shown below.

(2A)

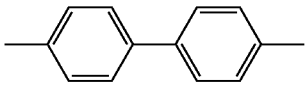

(2B)

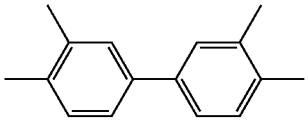

(2C)

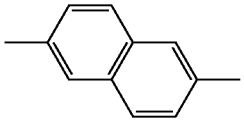

(2D)

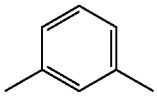

(2E)

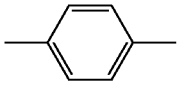

(2F)

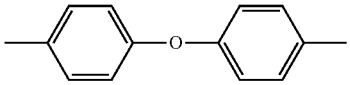

(2G)

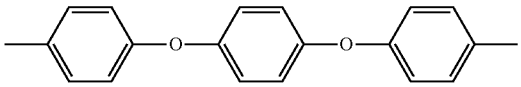

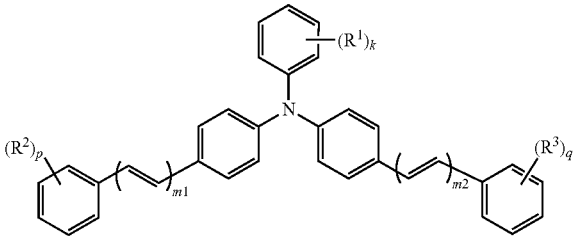

(HT)

In general formula (HT), $R^1$, $R^2$, and $R^3$ each represent, independently of one another, an alkoxy group having a carbon number of at least 1 and no greater than 4 or an alkyl group having a carbon number of at least 1 and no greater than 4. k, p, and q each represent, independently of one another, an integer of no less than 0 and no greater than 5. m1 and m2 each represent, independently of one another, an integer of at least 1 and no greater than 3. When k represents an integer of at least 2, plural chemical groups represented by $R^1$ may be the same as or different from one another. When p represents an integer of at least 2, plural chemical groups represented by $R^2$ may be the same as or different from one another. When q represents an integer of at least 2, plural chemical groups represented by $R^3$ may be the same as or different from one another.

(ET1)

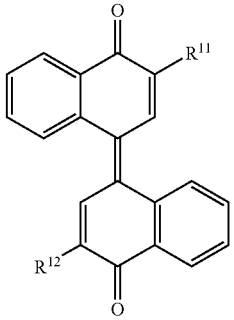

(ET2)

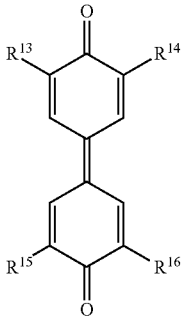

(ET3)

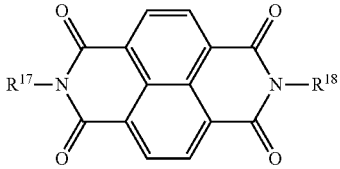

(ET4)

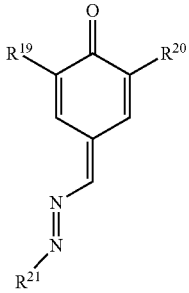

(ET5)

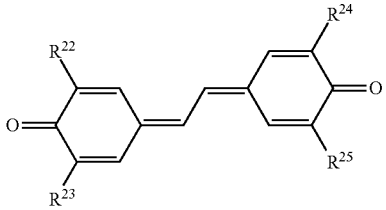

In general formula (ET1), $R^{11}$ and $R^{12}$ represent an alkyl group having a carbon number of at least 1 and no greater than 6. In general formula (ET2), $R^{13}$, $R^{14}$, $R^{15}$, and $R^{16}$ represent an alkyl group having a carbon number of at least 1 and no greater than 6. In general formula (ET3), $R^{17}$ and $R^{18}$ each represent, independently of one another, an aryl group having a carbon number of at least 6 and no greater than 14 and optionally having one or more alkyl groups having a carbon number of at least 1 and no greater than 3. In general formula (ET4), $R^{19}$ and $R^{20}$ represent an alkyl group having a carbon number of at least 1 and no greater than 6. $R^{21}$ represents an aryl group having a carbon number of at least 6 and no greater than 14 and optionally having one or more halogen atoms. In general formula (ET5), $R^{22}$, $R^{23}$, $R^{24}$, and $R^{25}$ represent an alkyl group having a carbon number of at least 1 and no greater than 6.

A process cartridge according to the present invention includes the electrophotographic photosensitive member described above.

An image forming apparatus according to the present invention includes an image bearing member, a charger, a light exposure section, a developing section, and a transfer section. The image bearing member is the electrophotographic photosensitive member described above. The charger charges a surface of the image bearing member. The charger has a positive charging polarity. The light exposure section exposes the surface of the image bearing member in a charged state to light to form an electrostatic latent image on the surface of the image bearing member. The developing section develops the electrostatic latent image into a toner image. The transfer section transfers the toner image from the image bearing member to a recording medium while in a state in which the surface of the image bearing member is in contact with the recording medium.

Advantageous Effects of Invention

According to the electrophotographic photosensitive member in the present invention, occurrence of transfer memory can be inhibited. According to the process cartridge and the image forming apparatus in the present invention, occurrence of an image defect can be inhibited.

DESCRIPTION OF EMBODIMENTS

Figure 1A:
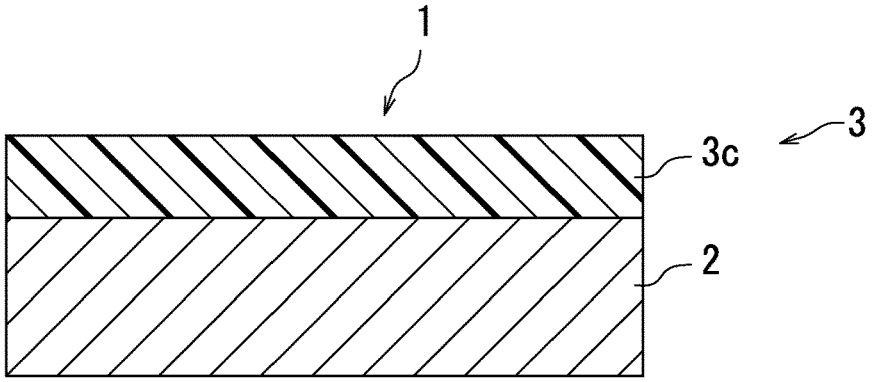
FIG. 1A is a schematic cross-sectional view illustrating a configuration of an electrophotographic photosensitive member according to a first embodiment of the present invention.

The following describes embodiments of the present invention in detail, but the present invention is not in any way limited by the embodiments described below and appropriate variations may be made in practice within the intended scope of the present invention. Although description is omitted as appropriate in order to avoid repetition, such omission does not limit the essence of the present invention. In the present specification, the term "-based" may be appended to the name of a chemical compound to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

In the following, a halogen atom, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, an alkyl group having a carbon number of at least 1 and no greater than 2, an alkoxy group having a carbon number of at least 1 and no greater than 4, and an aryl group having a carbon number of at least 6 and no greater than 14 refer to the following.

Examples of the halogen atom include fluorine (a fluoro group), chlorine (a chloro group), bromine (a bromo group), and iodine (an iodo group).

The alkyl group having a carbon number of at least 1 and no greater than 6 is an unsubstituted straight chain or branched chain group. Examples of the alkyl group having a carbon number of at least 1 and no greater than 6 include a methyl group, an ethyl group, a propyl group, an isopropyl group, an n-butyl group, an s-butyl group, a t-butyl group, a pentyl group, an isopentyl group, a neopentyl group, and a hexyl group.

The alkyl group having a carbon number of at least 1 and no greater than 5 is an unsubstituted straight chain or branched chain group. Examples of the alkyl group having a carbon number of at least 1 and no greater than 5 include a methyl group, an ethyl group, a propyl group, an isopropyl group, an n-butyl group, an s-butyl group, a t-butyl group, a pentyl group, an isopentyl group, and a neopentyl group.

The alkyl group having a carbon number of at least 1 and no greater than 4 is an unsubstituted straight chain or branched chain group. Examples of the alkyl group having a carbon number of at least 1 and no greater than 4 include a methyl group, an ethyl group, a propyl group, an isopropyl group, an n-butyl group, an s-butyl group, and a t-butyl group.

The alkyl group having a carbon number of at least 1 and no greater than 3 is an unsubstituted straight chain or branched chain group. Examples of the alkyl group having a carbon number of at least 1 and no greater than 3 include a methyl group, an ethyl group, a propyl group, and an isopropyl group.

The alkyl group having a carbon number of at least 1 and no greater than 2 is an unsubstituted straight chain group. Examples of the alkyl group having a carbon number of at least 1 and no greater than 2 include a methyl group and an ethyl group.

The alkoxy group having a carbon number of at least 1 and no greater than 4 is an unsubstituted straight chain or branched chain group. Examples of the alkoxy group having a carbon number of at least 1 and no greater than 4 include a methoxy group, an ethoxy group, an n-propoxy group, an isopropoxy group, an n-butoxy group, an s-butoxy group, and a t-butoxy group.

The aryl group having a carbon number of at least 6 and no greater than 14 is an unsubstituted group. Examples of the aryl group having a carbon number of at least 6 and no greater than 14 include an unsubstituted monocyclic aromatic hydrocarbon group having a carbon number of at least 6 and no greater than 14, an unsubstituted condensed bicyclic aromatic hydrocarbon group having a carbon number of at least 6 and no greater than 14, and an unsubstituted condensed tricyclic aromatic hydrocarbon group having a carbon number of at least 6 and no greater than 14. Examples of the aryl group having a carbon number of at least 6 and no greater than 14 include a phenyl group, a naphthyl group, an anthryl group, and a phenanthryl group.

First Embodiment: Electrophotographic Photosensitive Member

Figure 1B:
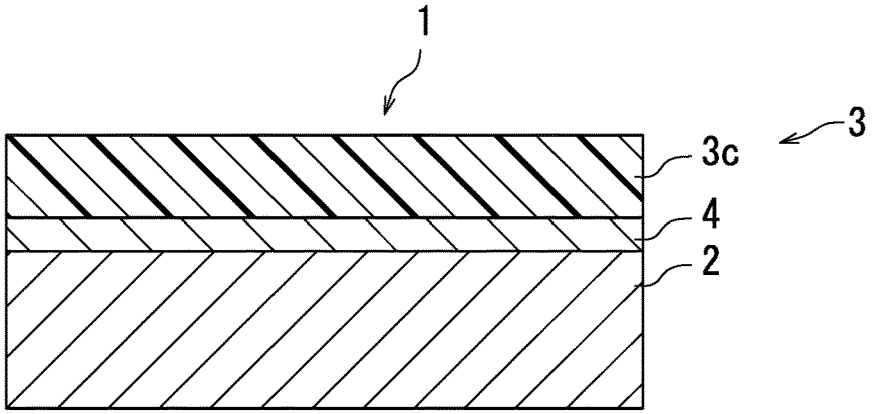
FIG. 1B is a schematic cross-sectional view illustrating a configuration of the electrophotographic photosensitive member according to the first embodiment of the present invention.
Figure 1C:
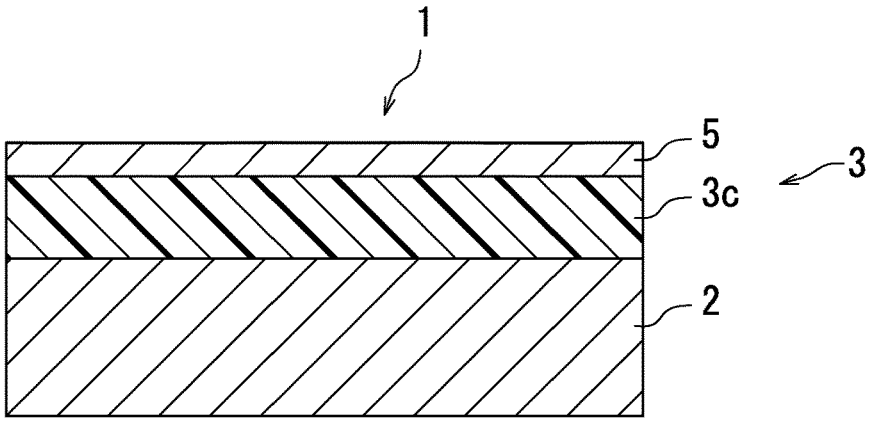
FIG. 1C is a schematic cross-sectional view illustrating a configuration of the electrophotographic photosensitive member according to the first embodiment of the present invention.

The following describes a structure of an electrophotographic photosensitive member (also referred to below as a photosensitive member) according to a first embodiment of the present invention. FIGS. 1A to 1C are schematic cross-sectional views each illustrating a configuration of a photosensitive member 1 according to the first embodiment. As illustrated in FIG. 1A, the photosensitive member 1 includes a conductive substrate 2 and a photosensitive layer 3. The photosensitive layer 3 is a single-layer photosensitive layer 3*c*. As illustrated in FIG. 1A, the photosensitive layer 3 may be disposed directly on the conductive substrate 2. Alternatively, the photosensitive member 1 includes for example the conductive substrate 2, an intermediate layer 4 (underlayer), and the photosensitive layer 3 as illustrated in FIG. 1B. As illustrated in FIG. 1B, the photosensitive layer 3 may be disposed indirectly on the conductive substrate 2. As illustrated in FIG. 1B, the intermediate layer 4 may be disposed between the conductive substrate 2 and the single-layer photosensitive layer 3*c*. As illustrated in FIG. 1C, the photosensitive member 1 may include a protective layer 5 serving as an outermost surface layer.

The photosensitive layer 3 contains a charge generating material, a hole transport material, an electron transport material, and a binder resin. The hole transport material includes a triphenylamine derivative represented by general formula (HT) (also referred to below as a triphenylamine derivative (HT)). The electron transport material includes a compound represented by general formula (ET1), general formula (ET2), general formula (ET3), general formula (ET4), or general formula (ET5) (also referred collectively to below as an electron transport material (ET)). The binder resin includes a polyarylate resin represented by general formula (1) (also referred to below as a polyarylate resin (1)). Through the photosensitive member 1 according to the first embodiment, occurrence of transfer memory is inhibited. Presumably, the reason therefor is as follows.

Transfer memory is described first in order to facilitate explanation. In electrophotographic image formation, an image forming process including the following steps 1) to 4) is performed, for example.

1) Positively charging a surface of an image bearing member (corresponding to a photosensitive member);

2) Exposing the surface of the image bearing member in a charged state to light to form an electrostatic latent image on the surface of the image bearing member;

3) Developing the electrostatic latent image into a toner image; and

4) Transferring the formed toner image from the image bearing member to a recording medium.

In an image forming process such as above, the image bearing member is rotated for use, which may involve occurrence of transfer memory caused due to the transferring. The following provides a more specific explanation. In the charging, the surface of the image bearing member is uniformly charged to a specific positive potential. Next, in the transferring after the exposing and the developing, a transfer bias having a charging polarity (negative charging polarity) opposite to that in the charging is applied to the image bearing member through the recording medium. In this connection, influence of the applied transfer bias of the opposite charging polarity may significantly reduce a potential of a non-exposed region (non-imaged region) of the surface of the image bearing member and the reduced potential state may be kept. Due to influence of the potential reduction in rotation by which the photosensitive member forms an image (also referred to below as a reference rotation), it is hard to charge the non-exposed region up to a desired positive potential in charging in rotation next to the reference rotation. By contrast, even in a state in which the transfer bias is applied, it is difficult to directly apply the transfer bias to the surface of the image bearing member having the exposed region to which toner is attached. Therefore, the potential of the exposed region (imaged region) hardly reduces. For the reason as above, the exposed region is readily charged to the desired positive potential in the charging in rotation next to the reference rotation. As a result, the charge potential differs between the exposed region and the non-exposed region, thereby making it difficult to uniformly charge the surface of the image bearing member to a specific positive potential. As described above, chargeability of the non-exposed region may lower due to influence of potential reduction by transfer bias in imaging (image forming process) in the reference rotation of the image bearing member. A phenomenon caused due to charge potential difference as such as above is called transfer memory.

The triphenylamine derivative (HT) has three benzene rings in its central triphenylamine structure. Of the three benzene rings, two benzene rings each include a phenylalkapolyenyl group (a specific example is a phenylethenyl group, a phenyl butadienyl group, or a phenylhexatrienyl group). The triphenylamine derivative (HT) has a π conjugated system that spatically spreads relatively widely. Therefore, a travel distance of carriers (holes) in a molecule of the triphenylamine derivative (HT) tends to be long. That is, an intra-molecule travel distance of the carriers (holes) tends to be long. Moreover, the π conjugated systems of molecules of the triphenylamine derivative (HT) in the photosensitive layer 3 tend to overlap with one another. As a result, an inter-molecule travel distance of the carriers (holes) of the molecules of the triphenylamine derivatives (HT) tends to decrease. That is, an inter-molecule travel distance of the carriers (holes) tends to decrease. By contrast, the triphenylamine derivative (HT) has one nitrogen atom in its molecule. Therefore, charge in the molecule tends not to be eccentric when compared to a compound having two nitrogen atoms in its molecule (for example, a diamine compound). Therefore, the triphenylamine derivative (HT) is thought to enhance acceptability (injection) and transportability of the carriers (holes) of the photosensitive member 1.

The electron transport material (ET) has a π conjugated system that spatcially spreads relatively widely. Therefore, the electron transport material (ET) is excellent in carrier (electrons) acceptability and the travel distance of the carriers (electrons) in a molecule of the electron transport material (ET) tends to be long. That is, an intra-molecule travel distance of the carriers (electrons) tends to be long. Moreover, the π conjugated systems of molecules of the electron transport material (ET) in the photosensitive layer tend to overlap with one another. As a result, an inter-molecule travel distance of the carriers (electrons) of the molecules of the electron transport material (ET) tends to decrease. That is, an inter-molecule travel distance of the carriers (electrons) tends to decrease. Therefore, the electron transport material (ET) is thought to enhance acceptability (injection) and transportability of the carrier (electrons) of the photosensitive member 1.

The polyarylate resin (1) includes repeating units each derived from a dicarboxylic acid and repeating units each derived from a diol as represented by general formula (1). The repeating units derived from a dicarboxylic acid each have a divalent substituent represented by chemical formula represented by any of (2A) to (2G). The repeating units derived from a diol each have a cycloalkylidene group. The polyarylate resin (1) having such a structure is excellent in compatibility with the triphenylamine derivative (HT) and the electron transport material (ET), and therefore, it is possible to readily disperse the triphenylamine derivative (HT) and the electron transport material (ET) in the photosensitive layer 3. For the reason described above, it is thought that occurrence of transfer memory can be inhibited through the photosensitive member 1 according to the first embodiment.

The following describes elements (the conductive substrate 2, the photosensitive layer 3, and the intermediate layer 4) of the photosensitive member 1 according to the first embodiment. A production method of the photosensitive member 1 will be also described.

[1. Conductive Substrate]

No specific limitations are placed on the conductive substrate 2 other than being a conductive substrate that can be used as a conductive substrate for the photosensitive member 1. The conductive substrate 2 can be a conductive substrate of which at least a surface portion is made from a material having conductivity (also referred to below as a conductive material). An example of the conductive substrate 2 is a substrate made from a conductive material. Another example of the conductive substrate is a conductive substrate covered with a conductive material. Examples of conductive materials that can be used include aluminum, iron, copper, tin, platinum, silver, vanadium, molybdenum, chromium, cadmium, titanium, nickel, palladium, and indium. Any one of the conductive materials listed above may be used independently, or any two or more of the conductive materials listed above may be used in combination. Examples of combinations of two or more of the conductive materials include alloys (specific examples include aluminum alloy, stainless steel, and brass). Among the conductive materials listed above, aluminum or an aluminum alloy is preferable in terms of favorable charge mobility from the photosensitive layer 3 to the conductive substrate 2.

The shape of the conductive substrate 2 may be selected as appropriate to match the configuration of an image forming apparatus in which the conductive substrate 2 is to be used. The conductive substrate 2 is for example in a sheet-shape or a drum-shape. The thickness of the conductive substrate 2 can be selected as appropriate in accordance with the shape of the conductive substrate 2.

[2. Photosensitive Layer]

The photosensitive layer 3 contains a charge generating material, a hole transport material, an electron transport material, and a binder resin. The photosensitive layer 3 may contain an additive. No specific limitations are placed on thickness of the photosensitive layer so long as the thickness thereof is sufficient to enable the photosensitive layer to function as a photosensitive layer. Specifically, the photosensitive layer 3 may have a thickness of at least 5 μm and no greater than 100 μm, and preferably has a thickness of at least 10 μm and no greater than 50 μm.

The following describes the charge generating material, the hole transport material, the electron transport material, the binder resin, and the additive.

[2-1. Charge Generating Material]

No specific limitations are placed on the charge generating material other than being a charge generating material that can be used in photosensitive members. Examples of the charge generating material that can be used include phthalocyanine-based pigments, perylene-based pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials such as selenium, selenium-tellurium, selenium-arsenic, cadmium sulfide, and amorphous silicon, pyrylium salts, anthanthrone-based pigments, triphenylmethane-based pigments, threne-based pigments, toluidine-based pigments, pyrazoline-based pigments, and quinacridone-based pigments. Examples of phthalocyanine-based pigments include phthalocyanine pigments and pigments of phthalocyanine derivatives. Examples of phthalocyanine pigments include metal-free phthalocyanine pigments (specific examples include an X-form metal-free phthalocyanine pigment (x-$H_2$Pc)). Examples of pigments of phthalocyanine derivatives include metal phthalocyanine pigments (specific examples include titanyl phthalocyanine pigments and V-form hydroxygallium phthalocyanine pigments). No specific limitations are placed on crystal structure of the phthalocyanine-based pigments, and phthalocyanine-based pigments having various crystal forms can be used. The phthalocyanine-based pigments for example have an α-form crystal structure, a β-form crystal structure, or a Y-form crystal structure. Any one of the charge generating materials may be used independently, or any two or more of the charge generating materials may be used in combination. Among the charge generating materials listed above, a phthalocyanine-based pigment is preferable and an X-form metal-free phthalocyanine pigment (x-$H_2$Pc) or a Y-form titanyl phthalocyanine pigment (Y-TiOPc) is more preferable.

Y-form titanyl phthalocyanine pigments exhibit a main peak at a Bragg angle 2θ±0.2°=27.2° in a CuKα characteristic X-ray diffraction spectrum. The term main peak refers to a peak having a highest or second highest intensity within a range of Bragg angles (2θ±0.2°) from 3° to 40° in a CuKα characteristic X-ray diffraction spectrum.

(CuKα Characteristic X-Ray Diffraction Spectrum Measuring Method)

The following describes a method for measuring a CuKα characteristic X-ray diffraction spectrum. A sample (a titanyl phthalocyanine pigment) is loaded into a sample holder of an X-ray diffraction spectrometer (for example, "RINT (registered Japanese trademark) 1100", product of Rigaku Corporation) and an X-ray diffraction spectrum is measured using a Cu X-ray tube, a tube voltage of 40 kV, a tube current of 30 mA, and CuKα characteristic X-rays having a wavelength of 1.542 Å. Measurement is performed in a measurement range (2θ) from 3° to 40° (start angel 3°, stop angle 40°) at a scanning speed of for example 10°/minute. A main peak in the obtained X-ray diffraction spectrum is determined and a Bragg angle of the main peak is read from the X-ray diffraction spectrum.

Any one charge generating material or a combination of two or more charge generating materials that is absorptive with respect to light in a desired wavelength region may be used. Further, it is preferable to use a photosensitive member having sensitivity in a wavelength range of at least 700 nm for example for a digital optical image forming apparatus. Examples of the digital optical image forming apparatus include a laser beam printer and a facsimile machine that use a light source such as a semiconductor laser. In view of the foregoing, for example, a phthalocyanine-based pigment is preferable and an X-form metal-free phthalocyanine pigment or a Y-form titanyl phthalocyanine pigment is more preferable.

A photosensitive member included in an image forming apparatus that uses a short-wavelength laser light source preferably contains an anthanthrone-based pigment or a perylene-based pigment as a charge generating material. The short-wavelength laser has a wavelength of for example at least 350 nm and no greater than 550 nm.

The charge generating material is for example a phthalocyanine-based pigment represented by any of chemical formulas (CGM-1) to (CGM-4) (also referred to below as charge generating materials (CGM-1) to (CGM-4), respectively).

(CGM-1)

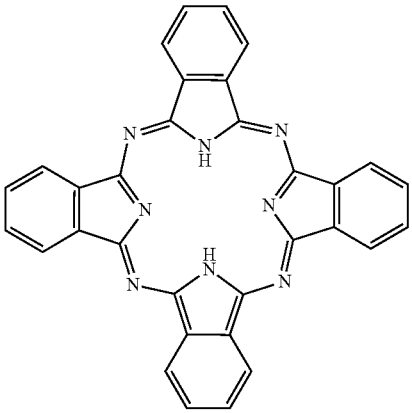

(CGM-2)

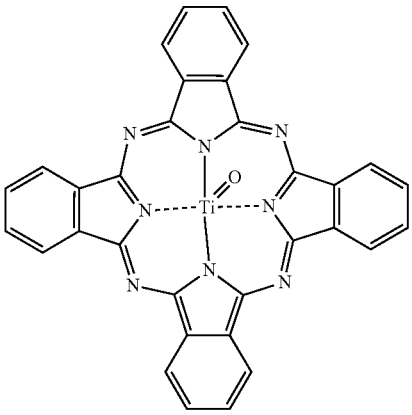

-continued (CGM-3)

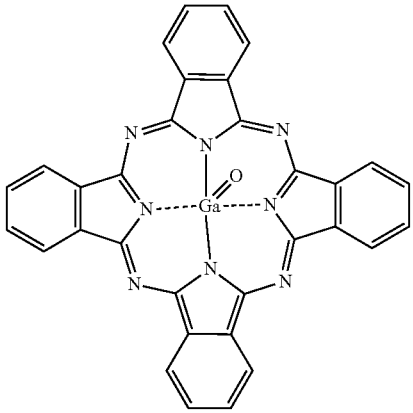

(CGM-4)

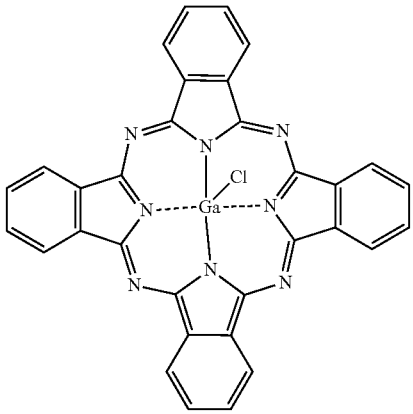

The charge generating material is preferably contained in an amount of at least 0.1 parts by mass and no greater than 50 parts by mass with respect to 100 parts by mass of the binder resin, more preferably at least 0.5 parts by mass and no greater than 30 parts by mass, and particularly preferably at least 0.5 parts by mass and no greater than 4.5 parts by mass.

[2-2. Hole Transport Material]

The hole transport material includes a triphenylamine derivative (HT). The triphenylamine derivative (HT) is represented by general formula (HT).

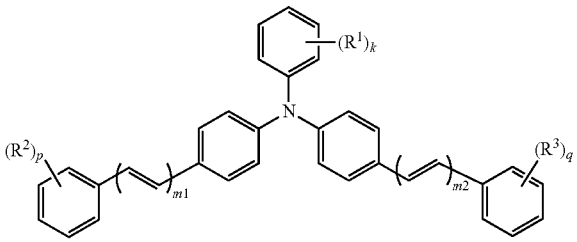

(HT)

In general formula (HT), $R^1$, $R^2$, and $R^3$ each represent, independently of one another, an alkyl group having a carbon number of at least 1 and no greater than 4 or an alkoxy group having a carbon number of at least 1 and no greater than 4. k, p, and q each represent, independently of one another, an integer of at least 0 and no greater than 5. m1 and m2 each represent, independently of one another, an integer of at least 1 and no greater than 3. When k represents an integer of at least 2, plural chemical groups represented by $R^1$ may be the same as or different from one another. When p represents an integer of at least 2, plural chemical groups represented by $R^2$ may be the same as or different from one another. When q represents an integer of at least 2, plural chemical groups represented by $R^3$ may be the same as or different from one another.

In general formula (HT), an alkyl group having a carbon number of at least 1 and no greater than 4 that may be represented by $R^1$ is preferably a methyl group, an ethyl group, or an n-butyl group. An alkoxy group having a carbon number of at least 1 and no greater than 4 that may be represented by $R^1$ is preferably an ethoxy group or an n-butoxy group. A substituent that may be represented by $R^1$ may be located at an ortho position (o position), a meta position (m position), or a para position (p position) of a benzene ring relative to a bond to the nitrogen atom, and is preferably located at an ortho position or a para position.

In general formula (HT), it is preferable that: $R^1$ represents a chemical group selected from the group consisting of alkoxy groups having a carbon number of at least 1 and no greater than 4 and alkyl groups having a carbon number of at least 1 and no greater than 4; k represents 1 or 2; when k represents 2, two chemical groups $R^1$ may be the same as or different from each other; p and q represent 0; and m1 and m2 represent 2 or 3.

In terms of further inhibition of occurrence of transfer memory and improvement in sensitivity characteristics of the photosensitive member, it is preferable that in general formula (HT), $R^1$ represents an alkyl group having a carbon number of at least 1 and no greater than 4 and k represents 2.

In terms of further inhibition of occurrence of transfer memory and improvement in sensitivity characteristics of the photosensitive member, it is preferable that m1 and m2 in general formula (HT) represent 3.

Examples of the triphenylamine derivative (HT) include triphenylamine derivatives represented by chemical formula (HT-1), chemical formula (HT-2), chemical formula (HT-3), chemical formula (HT-4), chemical formula (HT-5), chemical formula (HT-6), and chemical formula (HT-7) (also referred to below as a triphenylamine derivative (HT-1), a triphenylamine derivative (HT-2), a triphenylamine derivative (HT-3), a triphenylamine derivative (HT-4), a triphenylamine derivative (HT-5), a triphenylamine derivative (HT-6), and a triphenylamine derivative (HT-7), respectively).

(HT-1)

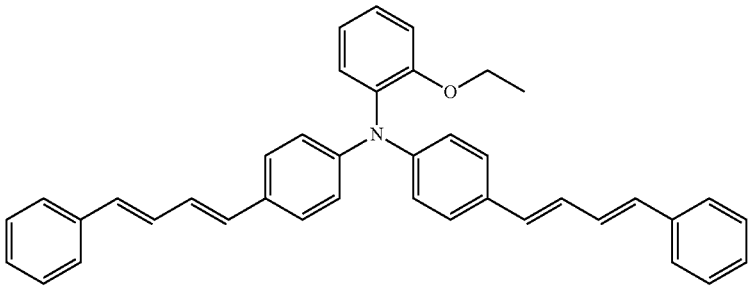

(HT-2)

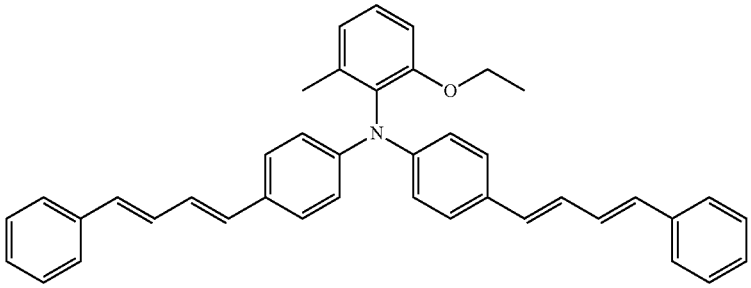

(HT-3)

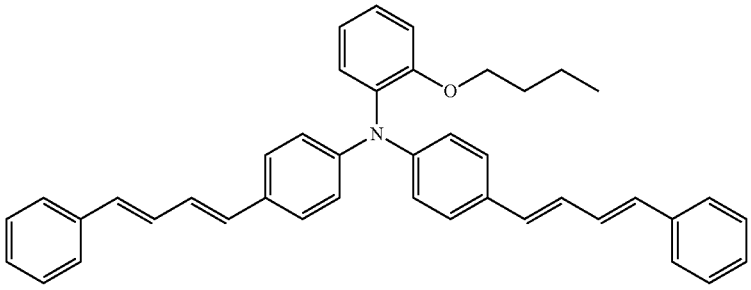

-continued (HT-4)

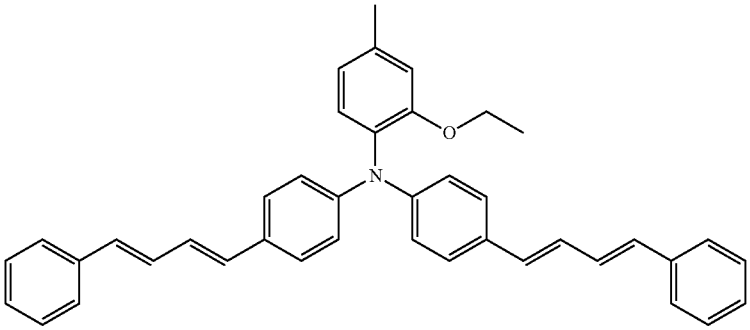

(HT-5)

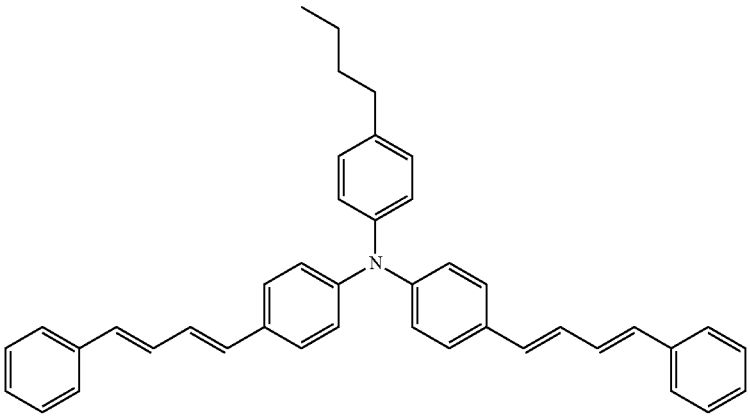

(HT-6)

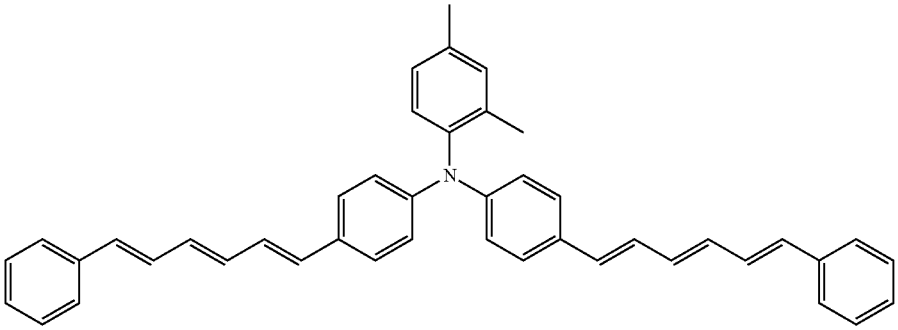

(HT-7)

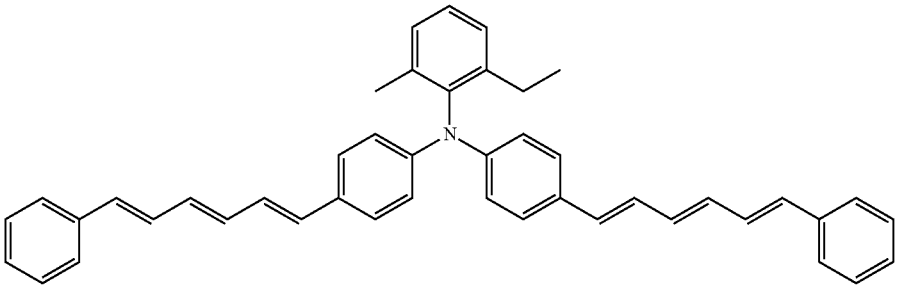

The hole transport material may include an additional hole transport material besides the triphenylamine derivative (HT). Examples of the additional hole transport material that can be used include nitrogen-containing cyclic compounds and condensed polycyclic compounds. Examples of the nitrogen-containing cyclic compounds and the condensed polycyclic compounds include diamine derivatives (specific examples include N,N,N',N'-tetraphenylphenylenediamine derivative, N,N,N',N'-tetraphenylnaphtylenediamine derivative, and N,N,N',N'-tetraphenylphenanthrylenediamine derivative); oxadiazole-based compounds (specific examples include 2,5-di(4-methylaminophenyl)-1,3,4-oxadiazole); styryl-based compounds (specific examples include 9-(4-diethylaminostyryl)anthracene); carbazole-based compounds (specific examples include polyvinyl carbazole); organic polysilane compounds; pyrazoline-based compounds (specific examples include 1-phenyl-3-(p-dimethylaminophenyl)pyrazoline); hydrazone-based compounds; indole-based compounds; oxazole-based compounds; isoxazole-based compounds; thiazole-based compounds; thiadiazole-based compounds; imidazole-based compounds; pyrazole-based compounds; and triazole-based compounds.

The hole transport material is preferably contained in an amount of at least 10 parts by mass and no greater than 200 parts by mass relative to 100 parts by mass of the binder resin, and more preferably at least 10 parts by mass and no greater than 100 parts by mass.

[2-3. Electron Transport Material]

The electron transport material includes a compound represented by general formula (ET1), general formula (ET2), general formula (ET3), general formula (ET4), or general formula (ET5). In the following description, these electron transport materials may be also referred to as an electron transport material (ET1), an electron transport material (ET2), an electron transport material (ET3), an electron transport material (ET4), and an electron transport material (ET5), respectively.

(ET1)

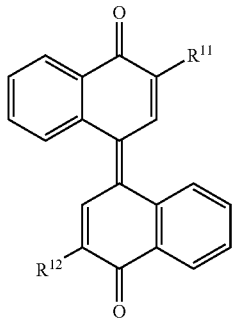

(ET2)

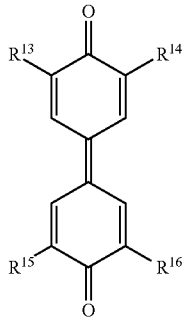

(ET3)

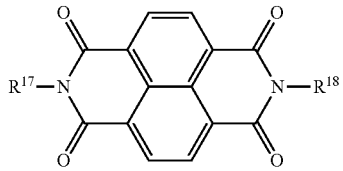

(ET4)

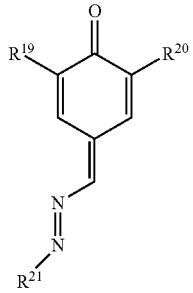

-continued (ET5)

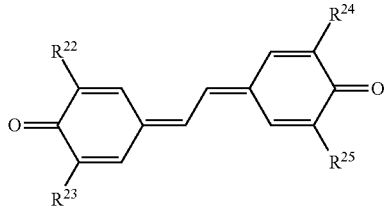

In general formula (ET1), $R^{11}$ and $R^{12}$ represent an alkyl group having a carbon number of at least 1 and no greater than 6. In general formula (ET2), $R^{13}$, $R^{14}$, $R^{15}$, and $R^{16}$ represent an alkyl group having a carbon number of at least 1 and no greater than 6. In general formula (ET3), $R^{17}$ and $R^{18}$ each represent, independently of one another, an aryl group having a carbon number of at least 6 and no greater than 14 and optionally having one or more alkyl groups having a carbon number of at least 1 and no greater than 3. In general formula (ET4), $R^{19}$ and $R^{20}$ each represent, independently of one another, an alkyl group having a carbon number of at least 1 and no greater than 6. $R^{21}$ represents an aryl group having a carbon number of at least 6 and no greater than 14 and optionally having one or more halogen atoms. In general formula (ET5), $R^{22}$, $R^{23}$, $R^{24}$, and $R^{25}$ represent an alkyl group having a carbon number of at least 1 and no greater than 6.

In terms of further inhibition of occurrence of transfer memory and improvement in sensitivity characteristics of the photosensitive member 1, the electron transport material (ET5) is preferable among the electron transport materials (ET1) to (ET5).

In general formula (ET1), $R^{11}$ and $R^{12}$ preferably represent an alkyl group having a carbon number of at least 1 and no greater than 5, and more preferably a 2-methyl-2-butyl group. An example of the electron transport material (ET1) is an electron transport material represented by chemical formula (ET1-1) (also referred to below as an electron transport material (ET1-1)).

In general formula (ET2), $R^{13}$, $R^{14}$, $R^{15}$, and $R^{16}$ preferably represent an alkyl group having a carbon number of at least 1 and no greater than 4 and a methyl group or a t-butyl group is more preferable. An example of the electron transport material (ET2) is an electron transport material represented by chemical formula (ET2-1) (also referred to below as an electron transport material (ET2-1)).

In general formula (ET3), $R^{17}$ and $R^{18}$ preferably represent a phenyl group having plural alkyl groups having a carbon number of at least 1 and no greater than 2 and 2-methyl-6-methylphenyl group is more preferable. An example of the electron transport material (ET3) is an electron transport material represented by chemical formula (ET3-1) (also referred to below as an electron transport material (ET3-1)).

In general formula (ET4), $R^{19}$ and $R^{20}$ preferably represent an alkyl group having a carbon number of at least 1 and no greater than 4 and a t-butyl group is more preferable. $R^{21}$ preferably represents a phenyl group having a halogen atom, more preferably represents a chlorophenyl group, and further preferably represents a p-chlorophenyl group. An example of the electron transport material (ET4) is an electron transport material represented by chemical formula (ET4-1) (also referred to below as an electron transport material (ET4-1)).

In general formula (ET5), $R^{22}$, $R^{23}$, $R^{24}$, and $R^{25}$ preferably represent an alkyl group having a carbon number of at least 1 and no greater than 4 and more preferably represent a methyl group or a t-butyl group. An example of the electron transport material (ET5) is an electron transport material represented by chemical formula (ET5-1) (also referred to below as an electron transport material (ET5-1)).

It is preferable that: in general formula (ET1), $R^{11}$ and $R^{12}$ represent an alkyl group having a carbon number of at least 1 and no greater than 5; in general formula (ET2), $R^{13}$, $R^{14}$, $R^{15}$, and $R^{16}$ represent an alkyl group having a carbon number of at least 1 and no greater than 4; in general formula (ET3), $R^{17}$ and $R^{18}$ represent a phenyl group having plural alkyl groups having a carbon number of at least 1 and no greater than 2; in general formula (ET4), $R^{19}$ and $R^{20}$ represent an alkyl group having a carbon number of at least 1 and no greater than 4 and $R^{21}$ represents a phenyl group having a halogen atom; and in general formula (ET5), $R^{22}$, $R^{23}$, $R^{24}$, and $R^{25}$ represent an alkyl group having a carbon number of at least 1 and no greater than 4.

(ET1-1)

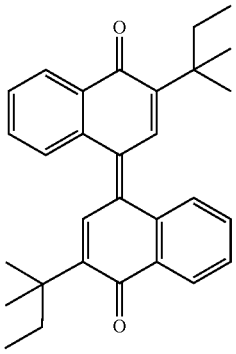

(ET2-1)

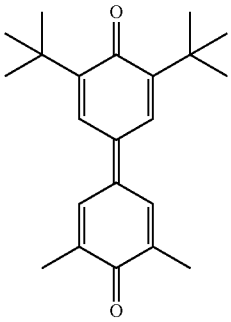

-continued (ET3-1)

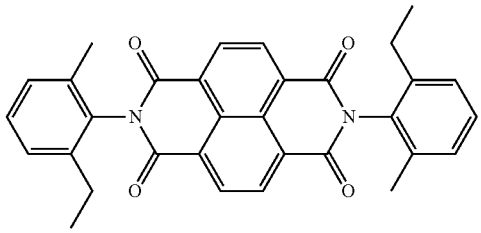

(ET4-1)

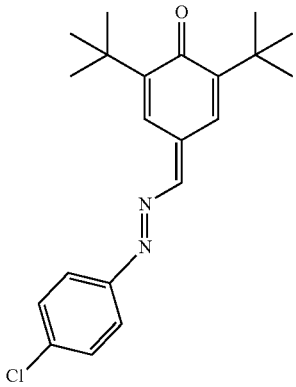

(ET5-1)

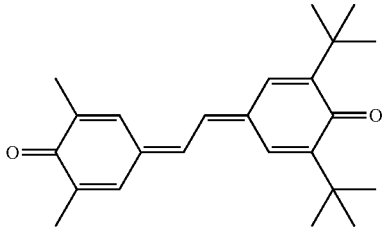

[2-4. Binder Resin]

The binder resin includes a polyarylate resin (1). The polyarylate resin (1) is represented by general formula (1).

(1)

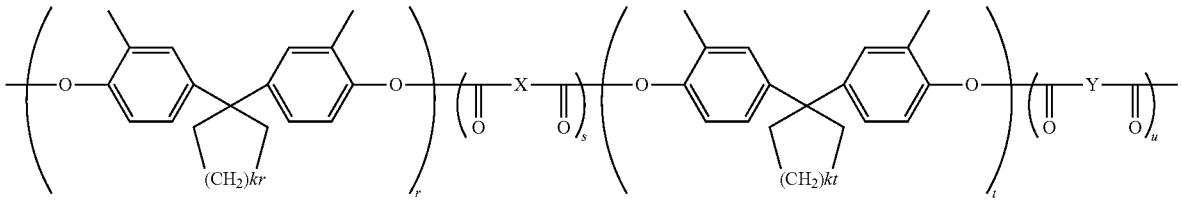

In general formula (1), r and s represent an integer of at least 0 and no greater than 49. t and u represent an integer of at least 1 and no greater than 50. r+s+t+u=100. r+t=s+u. r and t may be the same as or different from each other. s and u may be the same as or different from each other. kr represents 2 or 3. kt represents 2 or 3. X and Y each represent, independently of one another, a divalent group represented by chemical formula (2A), chemical formula (2B), chemical formula (2C), chemical formula (2D), chemical formula (2E), chemical formula (2F), or chemical formula (2G).

(2A)

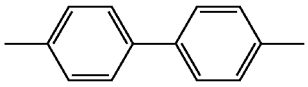

(2B)

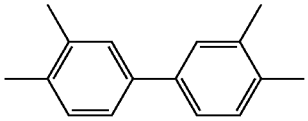

(2C)

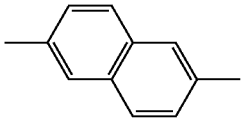

(2D)

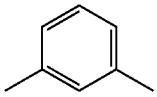

(2E)

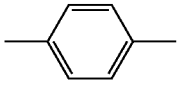

(2F)

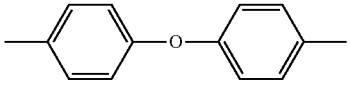

(2G)

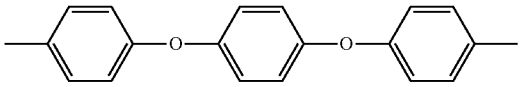

It is preferable in general formula (1) that: X and Y each represent, independently of one another, a divalent group represented by chemical formula (2A), chemical formula (2C), chemical formula (2D), chemical formula (2E), chemical formula (2F), or chemical formula (2G); X and Y are different from each other; and kr and kt represent 3.

The polyarylate resin (1) includes a repeating unit represented by general formula (1-5) (also referred to below as a repeating unit (1-5)), a repeating unit represented by general formula (1-6) (also referred to below as a repeating unit (1-6)), a repeating unit represented by general formula (1-7) (also referred to below as a repeating unit (1-7)), and a repeating unit represented by general formula (1-8) (also referred to below as a repeating unit (1-8)).

(1-5)

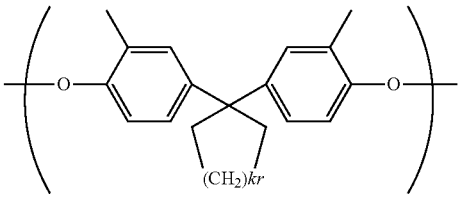

(1-6)

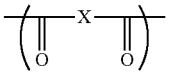

(1-7)

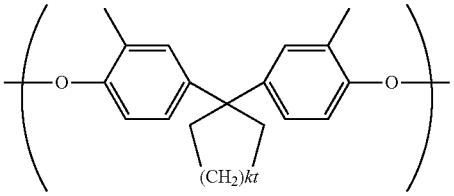

(1-8)

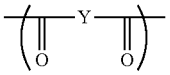

In the repeating units (1-5) to (1-8), kr, X, kt, and Y are the same as defined for kr, X, kt, and Y in general formula (1), respectively.

The polyarylate resin (1) may include a repeating unit other than the repeating units (1-5) to (1-8). A ratio (mole fraction) of a sum of the amounts by mole of the repeating units (1-5) to (1-8) to a total amount by mole of the repeating units included in the polyarylate resin (1) is preferably at least 0.80, more preferably at least 0.90, and further preferably 1.00.

No specific limitations are placed on arrangement of the repeating units (1-5) to (1-8) in the polyarylate resin (1) so long as the repeating units derived from an aromatic diol and the repeating units derived from an aromatic dicarboxylic acid are adjacent to one another. For example, the repeating unit (1-5) is located adjacent to the repeating unit (1-6) or the repeating unit (1-8) to be bonded thereto. Likewise, the repeating unit (1-7) is located adjacent to the repeating unit (1-6) or the repeating unit (1-8) to be bonded thereto. The polyarylate resin (1) may include a repeating unit other than the repeating units (1-5) to (1-8).

In general formula (1), r and s represent an integer of at least 0 and no greater than 49 and t and u represent an integer of at least 1 and no greater than 50. r+s+t+u=100. r+t=s+u. s/(s+u) is preferably at least 0.30 and no greater than 0.70. s/(s+u) represents a ratio (mole fraction) of a mass of the repeating unit (1-6) to a sum of a mass of the repeating unit (1-6) and a mass of the repeating unit (1-8) in the polyarylate resin (1).

The polyarylate resin (1) preferably has a viscosity average molecular weight of at least 40,000 and more preferably at least 40,000 and no greater than 52,500. When the viscosity average molecular weight of the polyarylate resin (1) is at least 40,000, abrasion resistance of the photosensitive member can be increased and the photosensitive layer 3 is hardly abraded. By contrast, when the viscosity average molecular weight of the polyarylate resin (1) is no greater than 52,500, the polyarylate resin (1) tends to easily dissolve in a solvent in formation of the photosensitive layer 3, facilitating formation of the photosensitive layer 3.

Examples of the polyarylate resin (1) include polyarylate resins represented by chemical formulas (R-1) to (R-11) (also referred to below as polyarylate resins (R-1) to (R-11), respectively).
(R-1)
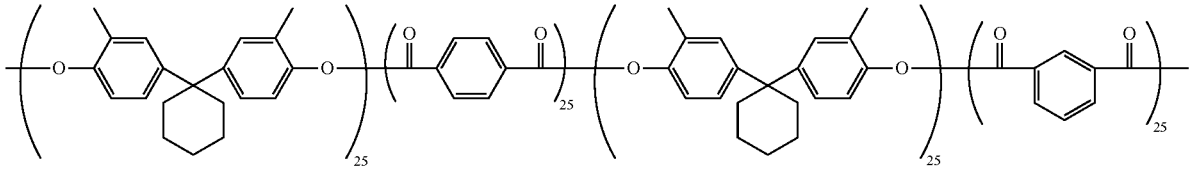
(R-2)
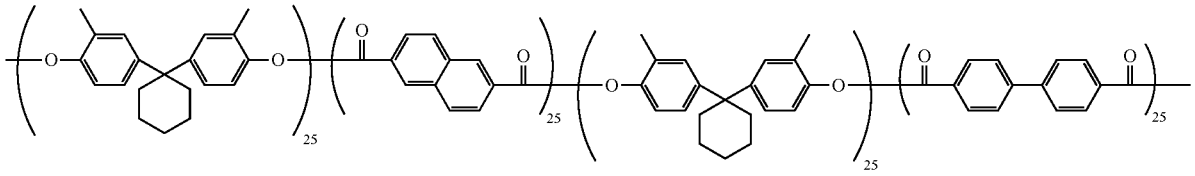
(R-3)
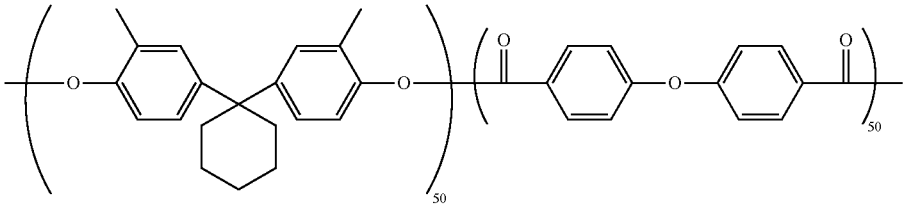
(R-4)
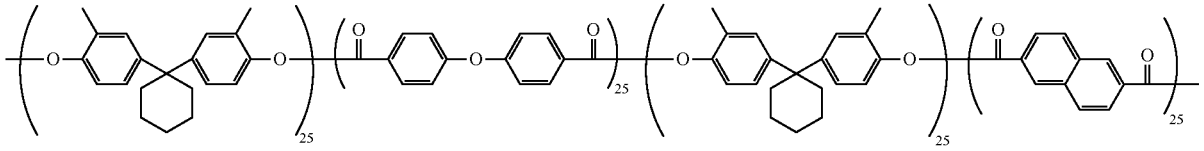
(R-5)
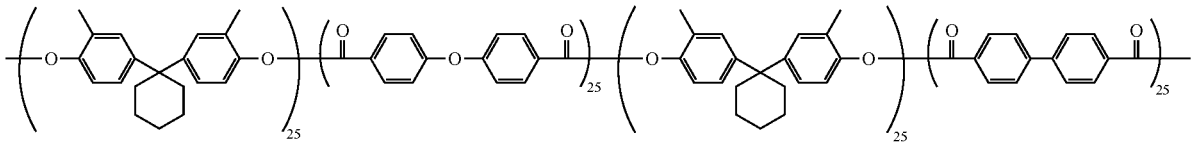
(R-6)
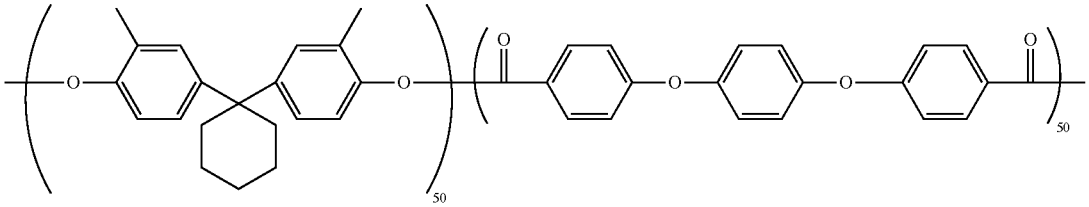

-continued (R-7)

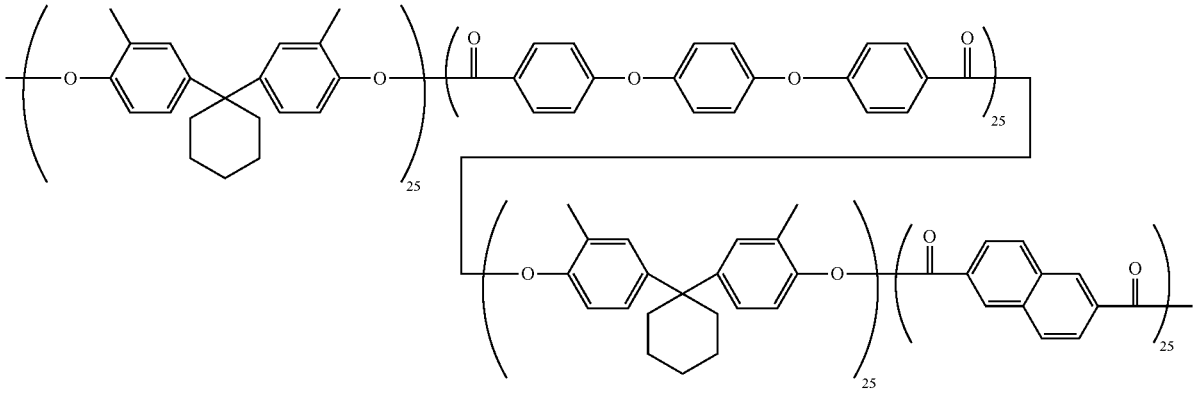

(R-8)

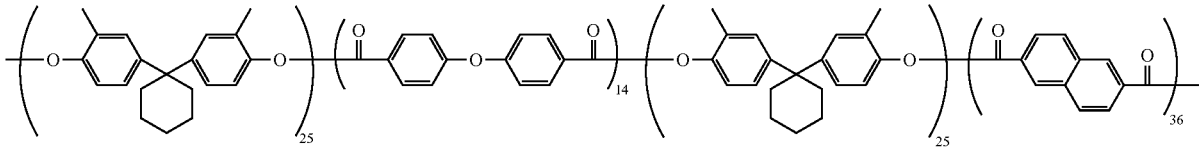

(R-9)

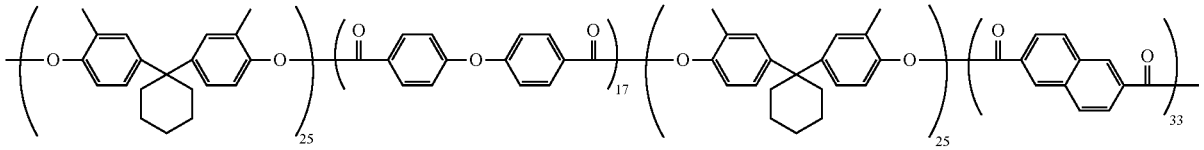

(R-10)

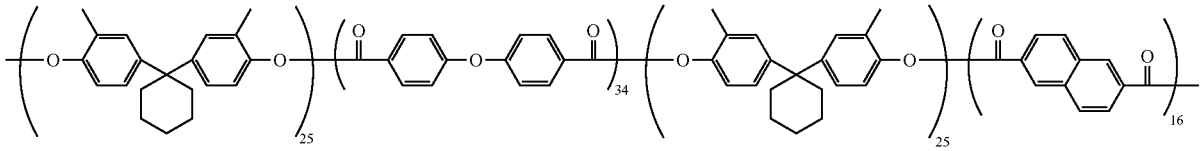

(R-11)

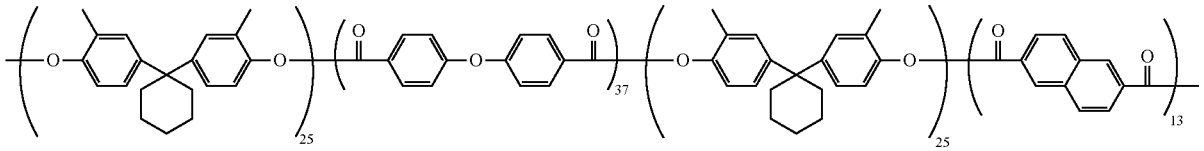

In terms of improvement in sensitivity characteristics of the photosensitive member, the polyarylate resin (R-2), (R-4), (R-6), or (R-8) is preferable among the polyarylate resins (R-1) to (R-11).

(Polyarylate Resin Production Method)

No specific limitations are placed on a production method of the binder resin (1) so long as the polyarylate resin (1) can be produced. An example of such production methods is a method by which aromatic diols and aromatic dicarboxylic acids for constituting the repeating units of the polyarylate resin (1) are condensation polymerized. No specific limitations are placed on a synthesis method of the polyarylate resin (1), and a known synthesis method (specifically, solution polymerization, melt polymerization, or interface polymerization) can be adopted. The following describes an example of production methods of the polyarylate resin (1).

The polyarylate resin (1) is produced for example by a reaction represented by chemical equation (R-1) (also referred to below as reaction (R-1)) or a method conforming thereto. The polyarylate resin production method includes for example reaction (R-1).

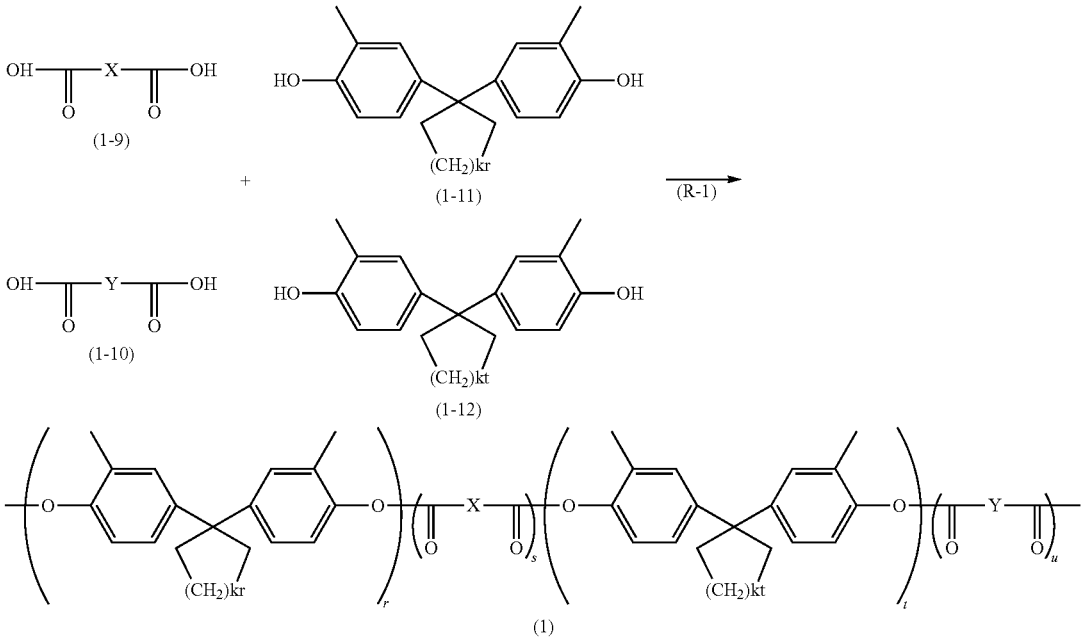

In reaction (R-1), kr in general formula (1-11), kt in general formula (1-12), X in general formula (1-9), and Yin general formula (1-10) are the same as defined for kr, kt, X, and Y in general formula (1), respectively.

In reaction (R-1), the polyarylate resin (1) is obtained through reaction between a combination of an aromatic dicarboxylic acid represented by general formula (1-9) and an aromatic dicarboxylic acid represented by general formula (1-10) (also referred to below as aromatic dicarboxylic acids (1-9) and (1-10), respectively) and a combination of an aromatic diol represented by general formula (1-11) and an aromatic diol represented by general formula (1-12) (also referred to below as aromatic diols (1-11) and (1-12), respectively).

Examples of the aromatic dicarboxylic acids (1-9) and (1-10) include 4,4'-dicarboxydiphenyl ether, 4,4'-dicarboxybiphenyl, terephthalic acid, isophthalic acid, and 2,6-naphthalene dicarboxylic acid. In reaction (R-1), an additional aromatic dicarboxylic acid may be used besides the aromatic dicarboxylic acids (1-9) and (1-10). Note that an aromatic dicarboxylic acid derivative can be used instead of either or both of the aromatic dicarboxylic acids in reaction (R-1). Examples of aromatic dicarboxylic acid derivative include halogenated alkanoyls and acid anhydrides of the aromatic dicarboxylic acids (1-9) and (1-10).

Examples of the aromatic diols (1-11) and (1-12) include 1,1-bis(4-hydroxy-3-methylphenyl)cyclohexane and 1,1-bis(4-hydroxy-3-methylphenyl)cyclopentane. In reaction (R-1), an additional aromatic diol may be used besides the aromatic diols (1-11) and (1-12). Examples of the additional aromatic diol include bisphenol A, bisphenol S, bisphenol E, and bisphenol F. Note that an aromatic diol derivative can be used instead of either or both of the aromatic diols in the reaction (R-1). An example of the aromatic diol derivative is diacetate.

A sum of the amounts by mole of the aromatic diols (1-11) and (1-12) relative to 1 mole of a sum of the amounts by mole of the aromatic dicarboxylic acids (1-9) and (1-10) is preferably at least 0.9 moles and no greater than 1.1 moles. This is because the polyarylate resin (1) can be easily refined within the above range to increase percentage yield of the polyarylate resin (1).

Reaction (R-1) may proceed in the presence of an alkali and a catalyst.

Examples of the catalyst include tertiary ammoniums (specific examples include trialkylamine) and quaternary ammonium salts (specific examples include benzyltrimethylammonium bromide). Examples of the alkali include hydroxides of alkali metals (specific examples include sodium hydroxide and potassium hydroxide) and hydroxides of alkali earth metals (specific examples include calcium hydroxide). Reaction (R-1) may proceed in a solvent in an inert gas atmosphere. Examples of the solvent include water and chloroform. An example of the inert gas is argon. Reaction (R-1) is preferably continued for two hours to five hours. A reaction temperature is preferably 5° C. or higher and 25° C. or lower.

Another process (for example, refining) may be included in production of the polyarylate resin (1) as necessary. An example of such a process is refining. Examples of a refining method include known methods (specific examples include filtering, chromatography, and crystallization).

The polyarylate resin (1) only may be used independently as the binder resin. Alternatively, the binder resin may include a resin other than the polyarylate resin (1) (another resin) to the extent that effects of the present invention is not reduced. Examples of the other resin include thermoplastic resins (specific examples include polyarylate resins other than the polyarylate resin (1), polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomer, vinyl chloride-vinyl acetate copolymers, polyester resins, alkyd resins, polyamide resins, polyurethane resins, polysulfone resins, diallyl phthalate resins, ketone resins, polyvinyl butyral resins, polyether resins, and polyester resins), thermosetting resins (specific examples include silicone resins, epoxy resins, phenolic resins, urea resins, melamine resins, and other cross-linkable thermosetting resins), and photocurable resins (specific examples include epoxy-acrylic acid-based resins and urethane-acrylic acid-based copolymers). Any one of the resins listed above may be used independently, or any two or more of the resins listed above may be used in combination.

A ratio of a mass of the binder resin to a sum of the amounts by mole of all constitutional components contained in the photosensitive layer 3 (for example, the charge generating material, the hole transport material, the electron transport material, and the binder resin) is preferably at least 40% by mass and more preferably 80% by mass.

[2-5. Additives]

At least one of the photosensitive layer 3 and the intermediate layer 4 may contain various additives to the extent that the additives do not adversely affect electrophotographic characteristics. Examples of the additives include antidegradants (specific examples include antioxidants, radical scavengers, quenchers, and ultraviolet absorbing agents), softeners, surface modifiers, extenders, thickeners, dispersion stabilizers, waxes, donors, surfactants, and leveling agents.

[3. Intermediate Layer]

The photosensitive member 1 according to the first embodiment may optionally include the intermediate layer 4 (for example, an underlayer). The intermediate layer 4 for example contains inorganic particles and a resin (intermediate layer resin). Provision of the intermediate layer 4 can facilitate flow of current generated when the photosensitive member 1 is exposed to light and inhibit increasing electric resistance, while also maintaining insulation to a sufficient degree so as to inhibit occurrence of leakage current.

Examples of the inorganic particles include particles of metals (specific examples include aluminum, iron, and copper), particles of metal oxides (specific examples include titanium oxide, alumina, zirconium oxide, tin oxide, and zinc oxide), and particles of non-metal oxides (a specific example is silica). Any one of the types of inorganic particles listed above may be used independently, or any two or more of the types of organic particles listed above may be used in combination.

[4. Photosensitive Member Production Method]

The following describes a production method of the photosensitive member 1. The production method of the photosensitive member 1 includes for example a photosensitive layer formation process.

In the photosensitive layer formation process, an application liquid for forming the photosensitive layer 3 (also referred to below as an application liquid for photosensitive layer formation) is prepared. The application liquid for photosensitive layer formation is applied onto the conductive substrate 2 to form an applied film. Next, at least a portion of a solvent contained in the applied film is removed by drying the applied film by an appropriate method to form the photosensitive layer 3. The application liquid for photosensitive layer formation contains for example a charge generating material, a hole transport material, an electron transport material, a binder resin, and the solvent. An application liquid for photosensitive layer formation such as above is prepared by dissolving or dispersing the charge generating material, the hole transport material, the electron transport material, and the binder resin in the solvent. Various additives may optionally be added to the application liquid for photosensitive layer formation as necessary.

The following specifically describes the photosensitive layer formation process. No specific limitations are placed on the solvent contained in the application liquid for photosensitive layer formation other than being capable of dissolving or dispersing each component contained in the application liquid for photosensitive layer formation and capable of being easily removed from the applied film in drying the applied film. Specific examples of the solvent include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination. A non-halogenated solvent is preferably used among the solvents listed above.

The application liquid for photosensitive layer formation is prepared by mixing the components to disperse the components in the solvent. Mixing or dispersion can for example be performed using a bead mill, a roll mill, a ball mill, an attritor, a paint shaker, or an ultrasonic disperser.

The application liquid for photosensitive layer formation may for example contain a surfactant or a leveling agent in order to improve dispersibility of the components or improve surface flatness of the formed layers.

No specific limitations are placed on a method by which the application liquid for photosensitive layer formation is applied other than being a method that enables uniform application of the application liquid for photosensitive layer formation. Examples of application methods that can be used include dip coating, spray coating, spin coating, and bar coating.

No specific limitations are placed on a method for removing at least a portion of the solvent contained in the applied film other than being a method that can remove at least a portion of the solvent in the applied film (a specific example is evaporation). Examples of methods that can be used to remove the solvent include heating, pressure reduction, and a combination of heating and pressure reduction. A specific example of the method involves heat treatment (hot-air drying) using a high-temperature dryer or a reduced pressure dryer. The heat treatment is for example performed for three minutes or longer and 120 minutes or shorter at a temperature of 40° C. or higher and 150° C. or lower.

Note that the production method of the photosensitive member 1 may further include formation of the intermediate layer 4 as necessary. Formation of the intermediate layer 4 can be carried out by a method selected appropriately from known methods.

Second Embodiment: Image Forming Apparatus

Figure 2:
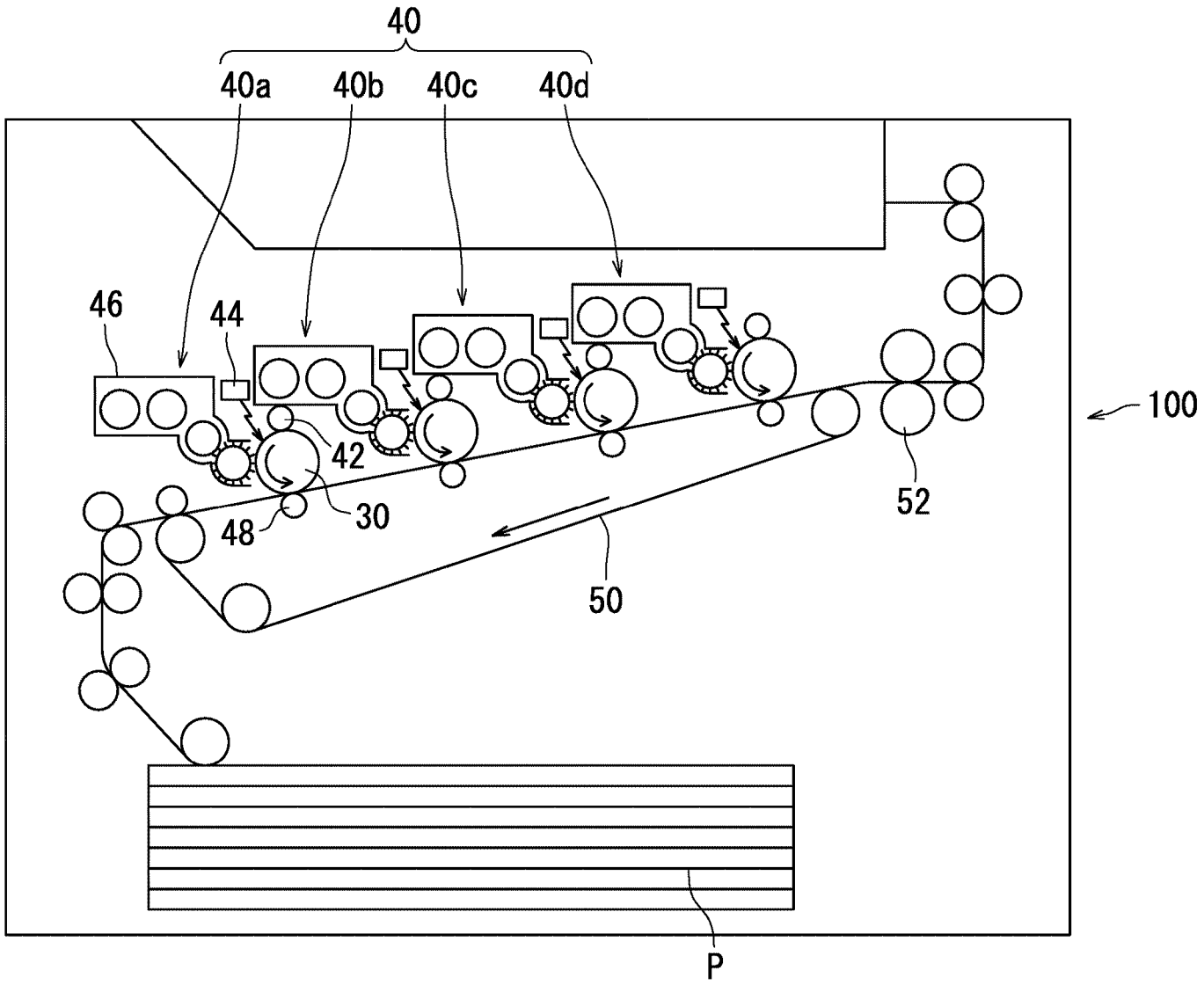
FIG. 2 is a diagram illustrating an example of an image forming apparatus according to a second embodiment of the present invention.

The following describes an aspect of an image forming apparatus according to a second embodiment with reference to FIG. 2. FIG. 2 is a diagram illustrating an example of an image forming apparatus 100 according to the second embodiment.

The image forming apparatus 100 according to the second embodiment includes an image forming unit 40. The image forming unit 40 includes an image bearing member 30, a charger 42, a light exposure section 44, a developing section 46, and a transfer section 48. The image bearing member 30 is the photosensitive member according to the first embodiment. The charger 42 charges a surface of the image bearing member 30. The charger 42 has a positive charging polarity. The light exposure section 44 exposes the surface of the image bearing member 30 in a charged state to light to form an electrostatic latent image on the surface of the image bearing member 30. The developing section 46 develops the electrostatic latent image into a toner image. The transfer section 48 transfers the toner image from the image bearing member 30 to a recording medium P in a state in which the surface of the image bearing member 30 and the recording medium P are in contact with each other. The image forming apparatus 100 according to the second embodiment has been schematically described.

An image defect (for example, an image defect caused due to occurrence of transfer memory) can be inhibited through the image forming apparatus 100 according to the second embodiment. Presumably, the reason therefor is as follows. The image forming apparatus 100 according to the second embodiment includes the image bearing member 30 that is the photosensitive member according to the first embodiment. Transfer memory can be inhibited from occurring through the photosensitive member according to the first embodiment. An image defect can accordingly be inhibited through the image forming apparatus 100 according to the second embodiment.

The following describes an image defect caused due to transfer memory. If transfer memory occurs in the image forming process, with respect to rotation of a photosensitive member in image formation (reference rotation), a region of the surface of the image bearing member 30 that cannot be charged to a desired potential in charging during the next rotation to the reference rotation tends to have a lower potential than other regions thereof that can be charged to the desired potential in the charging during the next rotation. Specifically, a non-exposed region of the surface of the image bearing member 30 in the reference rotation tends to have a lower potential than an exposed region thereof in the reference rotation in charging during the next rotation. Therefore, a potential of the non-exposed region in the reference rotation tends to to be lower in charging than that of the exposed region in the reference rotation, and accordingly, the non-exposed region tends to attract positively charged toner in development. As a result, an image reflecting a non-imaged portion (non-exposed region) in the reference rotation tends to be formed. Such an image defect resulting from formation of an image reflecting the imaged portion corresponding to the reference rotation is an image defect caused due to transfer memory (also referred to below as an image ghost).

Figure 3:
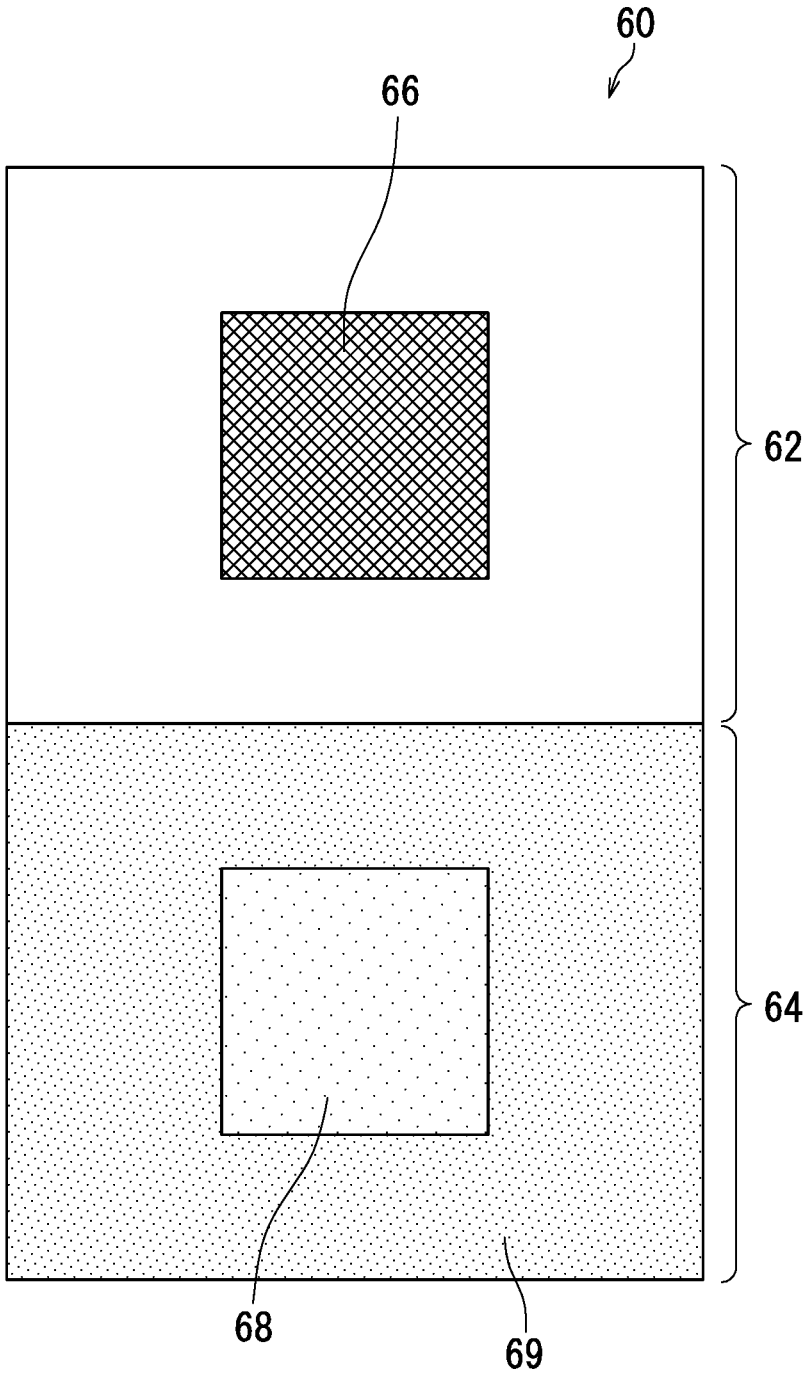
FIG. 3 is a diagram illustrating an image in which an image ghost has occurred.

The following describes an image in which an image defect has occurred with reference to FIG. 3. FIG. 3 is a diagram illustrating an image 60 in which an image ghost has occurred. The image 60 includes a region 62 and a region 64. The region 62 is a region corresponding to one rotation of the image bearing member 30. The region 64 is also a region corresponding to one rotation of the image bearing member 30. The image 62 includes an image 66. The image 66 is constituted by a solid image (image density 100%) in a square shape. The region 64 includes an image 68 and an image 69. The image 68 is a halftone image in a square shape. The image 69 is an outlined halftone image in a square shape in the region 64. The image 69 has a higher image density than the image 68. The image 69 includes an image defect (an image ghost) that has a higher image density than a designed image density through reflection of a non-exposed region of the region 62. Note that an image in the region 64 is constituted by a halftone image in its entirety ona design.

The following describes each element in detail with reference to FIG. 2. No specific limitations are placed on the image forming apparatus 100 other than being an electrophotographic image forming apparatus. The image forming apparatus 100 may be for example a monochrome image forming apparatus or a color image forming apparatus. In a configuration in which the image forming apparatus 100 is a color image forming apparatus, the image forming apparatus 100 is a tandem image forming apparatus. Description will be made below using an example of a tandem image forming apparatus 100.

The image forming apparatus 100 includes image forming units 40*a*, 40*b*, 40*c*, and 40*d*, a transfer belt 50, and a fixing section 52. Hereinafter, each of the image forming units 40*a*, 40*b*, 40*c*, and 40*d* is referred to as an image forming unit 40 where it is not necessary to distinguish among the image forming units 40*a*, 40*b*, 40*c*, and 40*d*. Note that in a configuration in which the image forming apparatus 100 is a monochrome image forming apparatus, the image forming apparatus 100 for example includes an image forming unit 40*a* and the image forming units 40*b* to 40*d* are omitted.

The image forming apparatus 100 adopts a direct transfer process. In general, an image forming apparatus adopting the direct transfer process transfers a toner image to a recording medium in a state in which a surface of an image bearing member is in contact with the recording medium. In the above configuration, the image bearing member receives more significant influence of transfer bias than an image bearing member included in an image forming apparatus adopting an intermediate transfer process. Therefore, it is generally difficult to inhibit occurrence of an image defect caused due to transfer memory through the image forming apparatus adopting the direct transfer process. However, the image forming apparatus 100 according to the second embodiment includes the photosensitive member according to the first embodiment. Transfer memory can be inhibited from occurring through the photosensitive member according to the first embodiment. Through the image forming apparatus 100 according to the second embodiment, which adopts the direct transfer process though, an image defect caused due to occurrence of transfer memory can be inhibited.

The image bearing member 30 is disposed at a central part of the image forming unit 40. The image bearing member 30 is rotatable in an arrow direction (in a counterclockwise direction). The charger 42, the light exposure section 44, the developing section 46, and the transfer section 48 are disposed around the image bearing member 30 in the stated order from upstream in a rotational direction of the image bearing member 30 starting from the charger 42 as a reference. Note that the image forming unit 40 may further include either or both a cleaner (not illustrated) and a static eliminator (not illustrated).

Toner images in different colors (for example, four colors of black, cyan, magenta, and yellow) are superimposed by the image forming units 40*a* to 40*d* one on the other on the recording medium P placed on the transfer belt 50.

The charger 42 charges the surface of the image bearing member 30 while in contact with the surface of the image bearing member 30. The charger 42 is a generally-called contact charger and is a charging roller. Another example of a contact charger is a charging brush. Alternatively, the charger may be a non-contact charger. Examples of the non-contact charger include a corotron charger and a scorotron charger.

The contact charger less charges the surface of the photosensitive member than the non-contact charger. For example, an image defect caused due to occurrence of transfer memory is hardly inhibited generally through an image forming apparatus including a charging roller. The image forming apparatus 100 according to the second embodiment includes the photosensitive member according to the first embodiment. Through the photosensitive member according to the first embodiment, occurrence of transfer memory is inhibited. Therefore, an image defect caused due to occurrence of transfer memory can be inhibited through the image forming apparatus 100 according to the second embodiment even including a contact charger.

Voltage that the charger 42 applies may be any of direct current voltage, alternating current voltage, and superimposed voltage, and preferably is direct current voltage. The term superimposed voltage means a voltage obtained through superposition of alternating current voltage on direct current voltage. In a configuration in which the charger 42 applies the direct current voltage to the image bearing member 30, an abrasion amount of an outermost surface layer (for example, a single-layer photosensitive layer) of the photosensitive layer can be reduced more than in a configuration in which the charger 42 applies the alternating current voltage or the superimposed voltage.

When the charger 42 applies the alternating current voltage, a surface potential of the surface of the image bearing member 30 tends to be uniform. Even when only the direct current voltage is applied in the image forming apparatus 100 including the contact charger 42, uniform charging can be also achieved. Application of only the direct current voltage to the charging roller can ensure that appropriate images are formed while the abrasion amount of the photosensitive layer is reduced.

The light exposure section 44 exposes the surface of the image bearing member 30 in a charged state to light. As a result, an electrostatic latent image is formed on the surface of the image bearing member 30. The electrostatic latent image is formed based on image data input to the image forming apparatus 100.

The developing section 46 supplies toner to the surface of the image bearing member 30 to develop the electrostatic latent image into a toner image. The developing section 46 can develop the electrostatic latent image into the toner image while in contact with the surface of the image bearing member 30.

The transfer belt 50 conveys the recording medium P between the image bearing member 30 and the transfer section 48. The transfer belt 50 is an endless belt. The image bearing member 50 is rotatable in an arrow direction (in a clockwise direction).

The transfer section 48 transfers the toner image developed by the developing section 46 from the surface of the image bearing member 30 to the recording medium P. An example of the transfer section 48 is a transfer roller. In a state in which the toner image is transferred from the image bearing member 30 to the recording medium P, the surface of the image bearing member 30 is in contact with the recording medium P.

The fixing section 52 applies either or both heat and pressure to the toner image which is unfixed and which has been transferred to the recording medium P by the transfer section 48. The fixing section 52 is for example either or both a heating roller and a pressure roller. The toner image is fixed to the recording medium P by applying either or both heat and pressure to the toner image. Through the above, an image is formed on the recording medium P.

Third Embodiment: Process Cartridge

A process cartridge according to a third embodiment includes the photosensitive member according to the first embodiment. The following describes the process cartridge according to the third embodiment with reference further to FIG. 2.

The process cartridge includes a unitized portion. The unitized portion is the image bearing member 30. The unitized portion is the image bearing member 30. The unitized portion may include at least one selected from the group consisting of the charger 42, the light exposure section 44, the developing section 46, and the transfer section 48 in addition to the image bearing member 30. The process cartridge corresponds to for example each of the image forming units 40*a* to 40*d*. The process cartridge may further include either or both a cleaner (not illustrated) and a static eliminator (not illustrated). The process cartridge is designed to be freely attachable to and detachable from the image forming apparatus 100. In the above configuration, the process cartridge is easy to handle and replaceable together with the image bearing member 30 in an easy and quick manner when sensitivity characteristics of the image bearing member 30 degrades.

EXAMPLES

The following provides more specific description of the present invention through use of Examples. However, note that the present invention is not limited to the scope of the Examples.

[Materials of Photosensitive Member]

(Hole Transport Material)

The triphenylamine derivatives (HT-1) to (HT-7) described in the first embodiment were prepared. Hole transport materials represented by chemical formulas (HT-8) and (HT-9) (also referred to below as hole transport materials (HT-8) and (HT-9), respectively) shown below were prepared each as a hole transport material.

(HT-8)

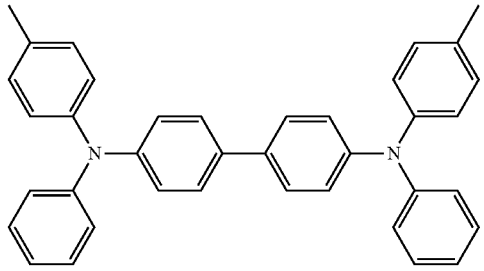

-continued (HT-9)

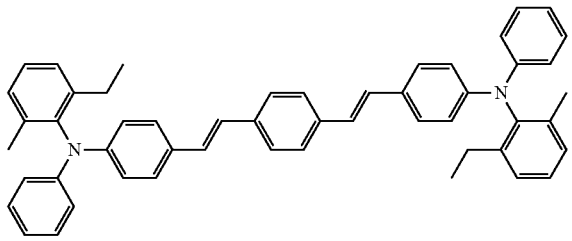

(Electron Transport Material)

The electron transport materials (ET1-1) to (ET5-1) described in the first embodiment were prepared. In addition, compounds represented by chemical formulas (ET6-1), (ET7-1), and (ET8-1) (also referred to below as electron transport materials (ET6-1), (ET7-1), and (ET8-1), respectively) shown below were prepared each as an electron transport material.

(ET6-1)

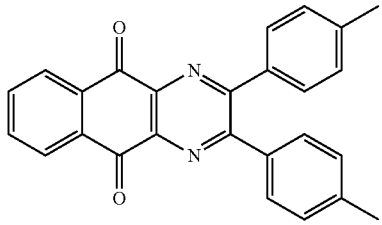

(ET7-1)

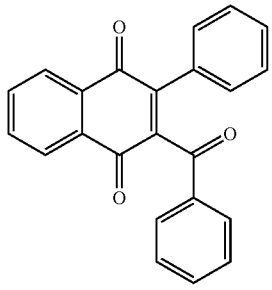

(ET8-1)

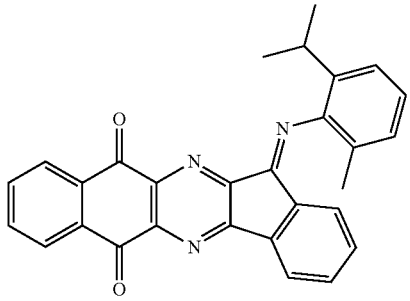

(Charge Generating Material)

The charge generating materials (CGM-1) and (CGM-2) described in the first embodiment were prepared. The charge generating material (CGM-1) was an X-form metal-free phthalocyanine represented by chemical formula (CGM-1).

The charge generating material (CGM-2) was a Y-form titanyl phthalocyanine pigment (Y-form titanyl phthalocyanine crystals) represented by chemical formula (CGM-2). The crystal structure thereof was Y-form.

The Y-form titanyl phthalocyanine crystals exhibited peaks at Bragg angles 2θ±0.2°=9.2°, 14.5°, 18.1°, 24.1°, and 27.2° in a CuKα characteristic X-ray diffraction spectral chart, and the main peak was 27.2°. Note that the CuKα characteristic X-ray diffraction spectrum was measured using the measuring device under the measurement conditions described in the first embodiment.

(Binder Resin)

[Polyarylate Resins (R-1) to (R-11)]

The polyarylate resins (R-1) to (R-11) described in the first embodiment were prepared.

[Synthesis of Polyarylate Resin (R-2)]

A three-necked flask was used as a reaction vessel. The reaction vessel was a 1-L three-necked flask equipped with a thermometer, a three-way cock, and a 200-mL dropping funnel. The reaction vessel was charged with 12.24 g (41.28 mM) of 1,1-bis(4-hydroxy-3-methylphenyl)cyclohexane, 0.062 g (0.413 mM) of t-butylphenol, 3.92 g (98 mM) of sodium hydroxide, and 0.120 g (0.384 mM) of benzyltributylammonium chloride. Subsequently, the flask was purged with argon. Thereafter, the reaction vessel was further charged with 300 mL of water. The internal temperature of the reaction vessel was increased to 50° C. The contents of the reaction vessel were stirred for one hour while the internal temperature of the reaction vessel was kept at 50° C. The internal temperature of the reaction vessel was then reduced to 10° C. Through the above, an alkaline aqueous solution was obtained.

Meanwhile, 4.10 g (16.2 mM) of 2,6-naphthalenedicarboxylic acid dichloride and 4.52 g (16.2 mM) of biphenyl-4,4'-dicarboxylic acid dichloride were dissolved in 150 mL of chloroform. Through the above, a chloroform solution was obtained.

Subsequently, the chloroform solution was gradually dripped into the alkaline solution using a dripping funnel over 110 minutes to initiate a polymerization reaction. The reaction vessel contents were stirred for four hours while the internal temperature of the reaction vessel was adjusted to 15±5° C. to promote the polymerization reaction.

Thereafter, an upper layer (water layer) of the reaction vessel contents was removed through decantation to obtain an organic layer. Next, a 1-L three-necked flask was charged with 400 mL of ion exchanged water and then charged with the resultant organic layer. The three-necked flask was further charged with 400 mL of chloroform and 2 mL of acetic acid. The three-necked flask contents were stirred at room temperature (25° C.) for 30 minutes. Thereafter, an upper layer (water layer) of the three-necked flask contents was removed through decantation to obtain an organic layer. The resultant organic layer was washed with 1 L of water using a separatory funnel. As a result, a washed organic layer was obtained.

Subsequently, the washed organic layer was filtered to collect a filtrate. A 3-L beaker was charged with 1 L of methanol. The resultant filtrate was dripped gradually into the beaker to isolate a precipitate. The precipitate was separated through filtration. The resultant precipitate was dried in a vacuum at 70° C. for 12 hours. As a result, the polyarylate resin (R-2) was obtained. The polyarylate resin (R-2) had a mass yield of 12.2 g and a percentage yield of 77% by mole.

[Synthesis of Polyarylate Resins (R-1) and (R-3) to (R-11)]

The polyarylate resins (R-1) and (R-3) to (R-11) were produced by the same method as for the polyarylate resin (R-2) in all aspects other than that: 1,1-bis(4-hydroxy-3-methylphenyl)cyclohexane was changed to an aromatic diol that was a starting substance of the respective polyarylate resins (R-1) and (R-3) to (R-11); and either or both 2,6-naphthalenedicarboxylic acid dichloride and biphenyl-4,4'-dicarboxylic acid dichloride were changed to a halogenated alkanoyl that was a starting substance of the respective polyarylate resins (R-1) and (R-3) to (R-11). Note that in a situation in which a plurality of aromatic carboxylic acids were used, the aromatic carboxylic acids were used at a content ratio equivalent to a mole fraction of s/(s+u). Furthermore, in a situation in which a plurality of aromatic diols were used, the aromatic diols were used at a content ratio equivalent to a mole fraction of r/(r+t).

Next, a $^1$H-NMR spectrum of each of the produced polyarylate resins (R-1) to (R-11) was measured using a proton nuclear magnetic resonance spectrometer (product of JASCO Corporation, 300 MHz). $CDCl_3$ was used as a solvent. Tetramethylsilane (TMS) was used as an internal standard sample. Among all, the polyarylate resins (R-2) and (R-4) are discussed as representative examples.

Figure 4:
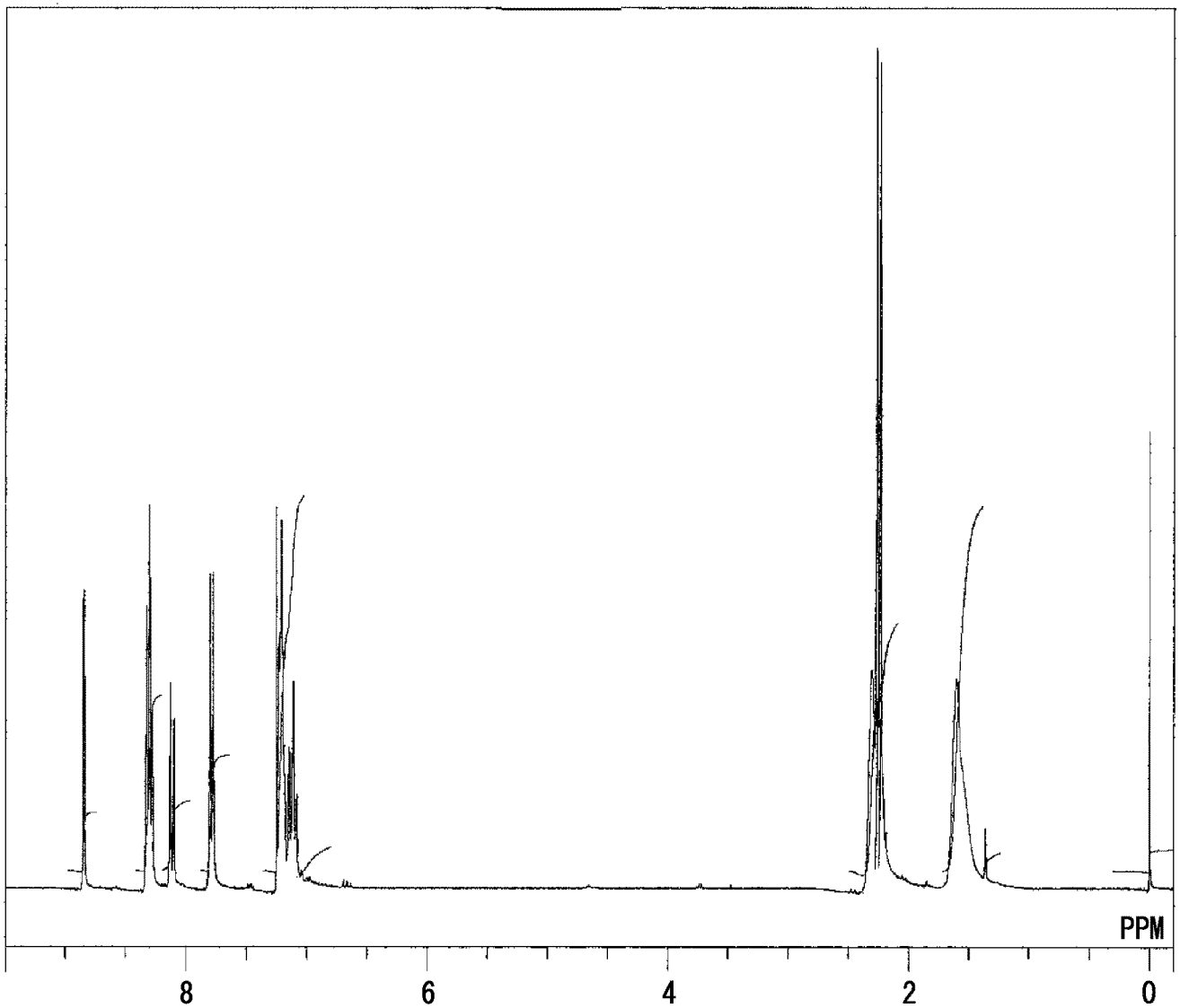
FIG. 4 is a $^{1}$H-NMR spectrum of a polyarylate resin represented by chemical formula (R-2).
Figure 5:
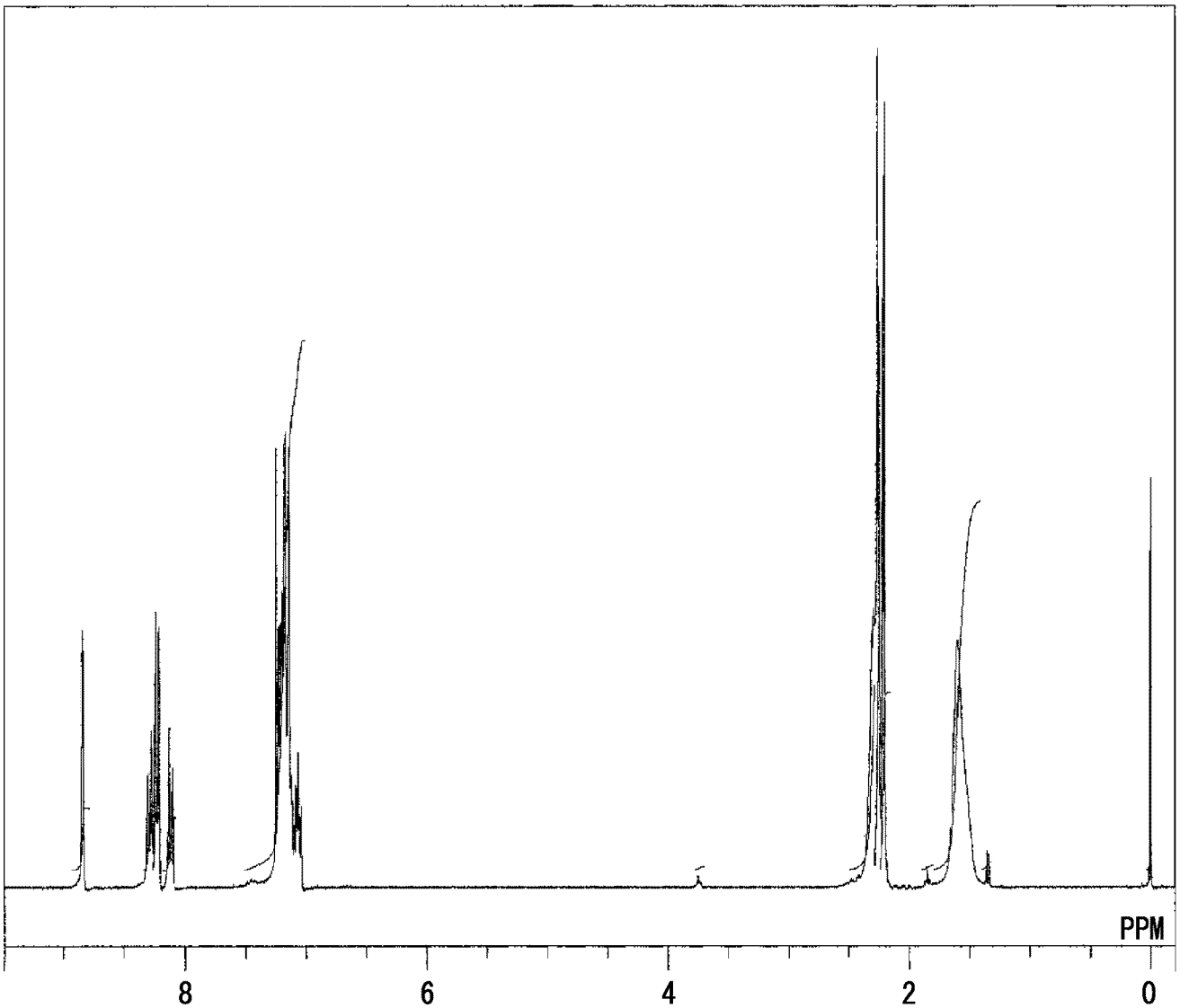
FIG. 5 is a $^{1}$H-NMR spectrum of a polyarylate resin represented by chemical formula (R-4).

FIGS. 4 and 5 show $^1$H-NMR spectra of the polyarylate resins (R-2) and (R-4), respectively. In FIGS. 4 and 5, horizontal axes indicate chemical shift (unit: ppm) and vertical axes indicate signal intensity (unit: arbitrary unit). It was confirmed from the $^1$H-NMR spectra that the polyarylate resins (R-2) and (R-4) were obtained. It was confirmed likewise from $^1$H-NMR spectra of the polyarylate resins (R-1), (R-3), and (R-5) to (R-11) that the polyarylate resins (R-1), (R-3), and (R-5) to (R-11) were obtained.

[Binder Resins (R-A) to (R-F)]

Binder resins (R-A) to (R-F) were prepared. The binder resins (R-A) to (R-F) are represented by chemical formulas (R-A) to (R-F), respectively, shown below.

[Production of Photosensitive Member (A-1)]

The following describes a production method of the photosensitive member (A-1) according to Example 1.

A container was charged with 5 parts by mass of the charge generating material (CGM-1), 50 parts by mass of the triphenylamine derivative (HT-1) as a hole transport material, 35 parts by mass of the electron transport material (ET1-1), 100 parts by mass of the polyarylate resin (R-1) as a binder resin, and 800 parts by mass of tetrahydrofuran as a solvent. The container contents were mixed for 50 hours using a ball mill in order to disperse the materials in the solvent. Through the above, an application liquid for photosensitive layer formation was obtained. The application liquid for photosensitive layer formation was applied onto an aluminum drum-shaped support (diameter 30 mm, total length 238.5 mm) as a conductive substrate by dip coating. After the application, the application liquid for photosensitive layer formation was hot-air dried at 100° C. for 40 minutes. Through the above, a single-layer photosensitive layer (film thickness 30 30 μm) was formed on the conductive substrate. The photosensitive member (A-1) was obtained as a result of the process described above.

[Photosensitive Members (A-2) to (A-22) and Photosensitive Members (B-1) to (B-11)]

Photosensitive members were produced by the same method as for the photosensitive member (A-1) in all aspects other than matters described below. Charge generating materials listed in Tables 1 and 2 were used instead of the charge generating material (CGM-1). Electron transport materials listed in Tables 1 and 2 were used instead of the electron transport material (ET1-1). Hole transport materials listed in (R-A)

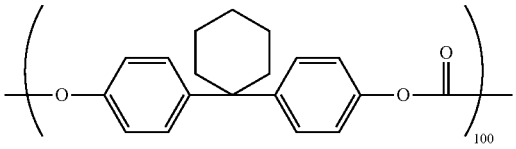

(R-B)

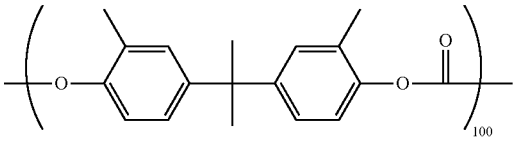

(R-C)

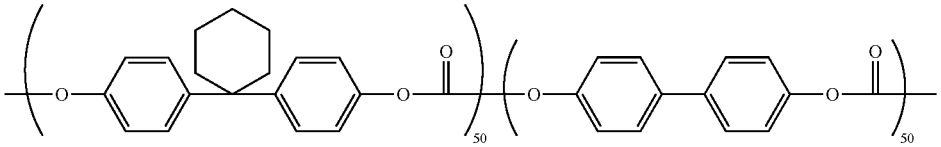

(R-D)

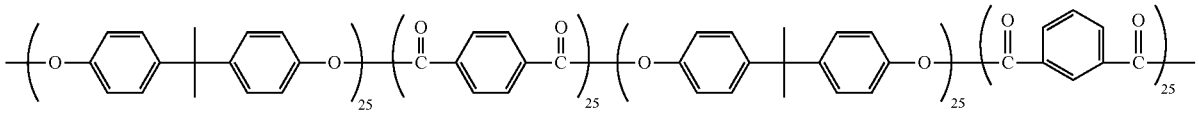

(R-E)

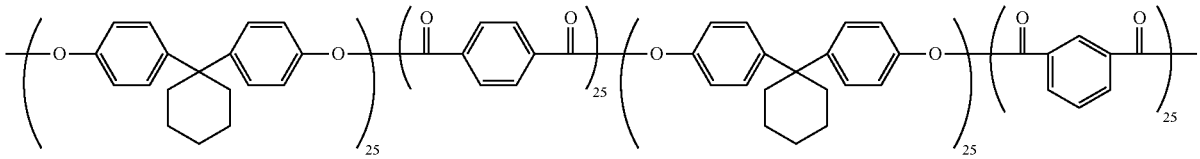

(R-F)

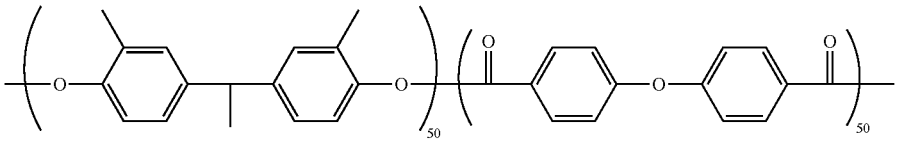

Tables 1 and 2 were used instead of the triphenylamine derivative (HT-1). Binder resins listed in Tables 1 and 2 were used instead of the polyarylate resin (R-1). Thus, photosensitive members (A-2) to (A-22) and photosensitive members (B-1) to (B-11) were obtained.

[Performance Evaluation for Photosensitive Member]

(Evaluation of Sensitivity Characteristics and Transfer Memory)

With respect to each of the photosensitive members (A-1) to (A-22) and (B-1) to (B-11), sensitivity characteristics and transfer memory were evaluated.

The photosensitive member was attached to an image forming apparatus ("FS-05250DN", product of KYOCERA Document Solutions Inc.). The image forming apparatus included a contract charging roller for applying direct current voltage as a charger. The image forming apparatus adopted an intermediate transfer process by which a toner image is directly transferred onto an intermediate transfer belt. A chargeable sleeve was disposed on the surface of the charging roller and was made from a chargeable rubber of which main constitutional material was an epichlorohydrin resin. A charge potential (blank paper portion potential Vs) of a portion of the photosensitive member corresponding to a non-exposed portion measured at a position of the photosensitive member located opposite to the developing section was set to +570 V±10 V by adjusting the charge voltage of the charger. A recording medium used was "Brand Paper of KYOCERA Document Solutions, VM-A4" (A4 size) available at KYOCERA Document Solutions Inc. Measurement was performed under ambient conditions of 23° C. and 50% relative humidity.

Subsequently, monochromatic light was taken out from white light of a halogen lamp using a bandpass filter. The taken-out monochromatic light was laser light having a wavelength of 780 nm, a half-width of 20 nm, and an optical energy of 1.16 μJ/cm$^2$. Charge potentials of portions of the photosensitive member in development through exposure to the laser light were measured. The surface potential of an exposed region as measured was determined to be a post-exposure potential $V_L$ (unit: V). The surface potential of a non-exposed region as measured was determined to be a blank paper portion potential $V_3$ (unit: V). Note that the post-exposure potential $V_L$ and the blank paper portion potential $V_3$ were measured in a state in which no transfer bias was applied. Next, a transfer bias of −2 kV was applied and a surface potential of the non-exposed region (blank paper portion) was measured in a state in which the transfer bias was applied. The surface potential of the non-exposed region (blank paper portion) as measured was determined to be a blank paper portion potential $V_4$. A transfer memory potential $\Delta V_{tc}$ (unit: V) was calculated from $V_3$ and $V_4$ measured as above using an expression "transfer memory potential $\Delta V_{tc}=V_4-V_3$".

Post-exposure potentials $V_L$ and transfer memory potentials $\Delta V_{tc}$ measured as above are shown in Tables 1 and 2. Note that a smaller value of the post-exposure potential $V_L$ indicates that a photosensitive member is more excellent in sensitivity characteristics. A smaller absolute value of the transfer memory potential $\Delta V_{tc}$ indicates that occurrence of transfer memory is more inhibited.

(Evaluation of Image Defect)

With respect to each of the photosensitive members (A-1) to (A-22) and (B-1) to (B-11), evaluation of an image defect was performed.

The photosensitive member was attached to an image forming apparatus ("FS-05250DN", product of KYOCERA Document Solutions Inc.). The image forming apparatus included a contract charging roller for applying direct current voltage as a charger. The image forming apparatus adopted an intermediate transfer process by which a toner image is directly transferred onto an intermediate transfer belt. A chargeable sleeve was disposed on the surface of the charging roller and was made from a chargeable rubber of which main constitutional material was an epichlorohydrin resin. A charge potential (blank paper portion potential Vs) of a portion of the photosensitive member corresponding to a non-exposed portion measured at a position of the photosensitive member located opposite to the developing section was set to +570 V±10 V by adjusting the charge voltage of the charger. Laser light was used as exposure light. The laser light was light obtained by taking monochromatic light out from white light of a halogen lamp using a bandpass filter and had a wavelength of 780 nm, a half-width of 20 nm, and an optical energy of 1.16 μJ/cm$^2$. A recording medium used was "Brand Paper of KYOCERA Document Solutions, VM-A4" (A4 size) available at KYOCERA Document Solutions Inc. Measurement was performed under ambient conditions of 23° C. and 50% relative humidity.

Figure 6:
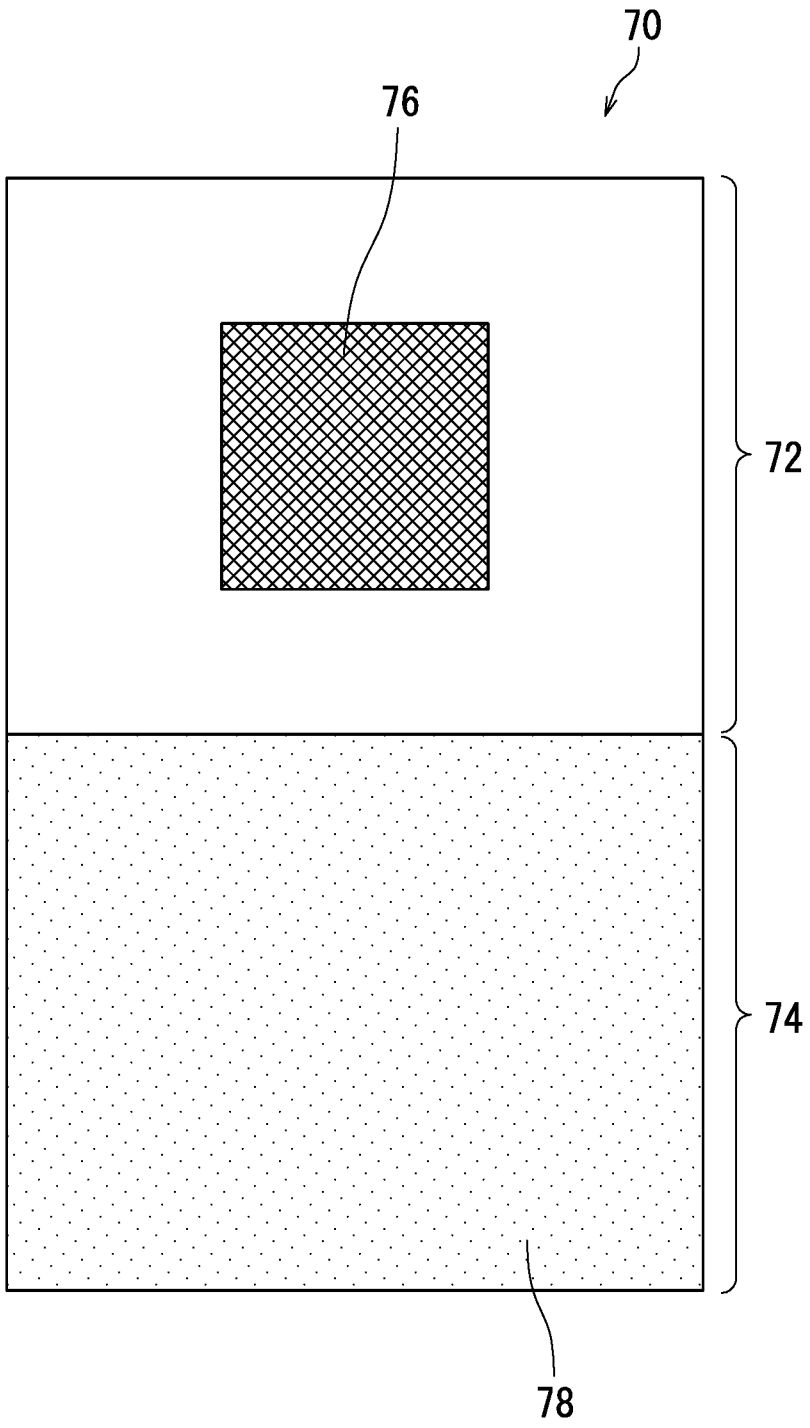
FIG. 6 is a diagram illustrating an evaluation image.

First, a printing test was performed. In the printing test, a print pattern (image density 40%) was printed on the recording medium continuously for one hour. Next, an evaluation image was formed. The following describes the evaluation image with reference to FIG. 6. FIG. 6 is a diagram illustrating an evaluation image 70. The evaluation image 70 includes a region 72 and a region 74. The region 72 is a region equivalent to one rotation of an image bearing member. The region 72 includes an image 76. The image 76 is constituted by a solid image (image density 100%) in a square shape. The region 74 is equivalent to one rotation of the image bearing member. The region 74 includes an image 78. The image 78 is constituted by a halftone image (image density 40%) in its entirety. The image 76 was formed first in the region 72, and the image 78 was then formed in the region 74. The image 76 is an image equivalent to one rotation of the photosensitive member, and the image 78 is an image equivalent to the next one rotation thereof with reference to the rotation through which the image 76 is formed. Note that an image in the region 72 other than the image 76 is a white image (image density 0%).

The evaluation image was visually observed to check the presence or absence of an image corresponding to the image 76 in the region 74. The visual observation herein refers to observation with an unaided eye (unaided eye observation) or observation through a loupe (×10, TL-SL10K, product of TRUSCO NAKAYAMA CORPORATION) (loupe observation). Whether or not an image defect (an image ghost) caused due to transfer memory occurred was checked. Whether or not an image ghost has occurred was evaluated according to the following criteria. Obtained evaluation results are shown in Tables 1 and 2. Note that evaluations A to C were determined to pass the evaluation.

(Evaluation Criteria for Image Ghost)

Evaluation A: An image ghost corresponding to the image 76 was not observed.

Evaluation B: An image ghost corresponding to the image 76 was slightly observed.

Evaluation C: An image ghost corresponding to the image 76 was observed of which level was practically negligible.

Evaluation D: An image ghost corresponding to the image 76 was observed of which level was practically significant.

Contrast between an image ghost observed and a non-imaged portion in which no image ghost was observed was low in an image evaluation sample.

Table 1 shows components and the evaluation results of the photosensitive members (A-1) to (A-22). Table 2 shows components and the evaluation results of the photosensitive members (B-1) to (B-11). In Tables 1 and 2, the term molecular weight for polyarylate resin refers to viscosity average molecular weight. HT-1 to HT-7, HT-8, and HT-9 in a column "Type for Hole transport material" in Tables 1 and 2 represent the triphenylamine derivatives (HT-1) to (HT-7) and the hole transport materials (HT-8) and (HT-9), respectively. ET1-1 to ET8-1 in a column "Type for Electron transport material" represent the electron transport materials (ET1-1) to (ET8-1), respectively. R-1 to R-11 and R-A to R-F in a column "Type for Binder resin" in Tables 1 and 2 represent the polyarylate resins (R-1) to (R-11) and the binder resins (R-A) to (R-F), respectively. CGM-1 and CGM-2 in a column "Type for Charge generating material" represent the charge generating materials (CGM-1) and (CGM-2), respectively.

TABLE 1

| | Photosensitive member | Hole transport material Type | Electron transport material Type | Binder resin Type | Binder resin Molecular weight | Charge generating material Type | Sensitivity characteristics Post-exposure potential $V_L$ (V) | Transfer memory potential ΔVtc (V) | Image evaluation |
|---|---|---|---|---|---|---|---|---|---|
| Example 1 | A-1 | HT-1 | ET1-1 | R-1 | 50500 | CGM-1 | +110 | −16 | A |
| Example 2 | A-2 | HT-1 | ET1-1 | R-2 | 50150 | CGM-1 | +103 | −15 | A |
| Example 3 | A-3 | HT-1 | ET1-1 | R-3 | 51000 | CGM-1 | +113 | −15 | A |
| Example 4 | A-4 | HT-1 | ET1-1 | R-4 | 51500 | CGM-1 | +106 | −18 | A |
| Example 5 | A-5 | HT-1 | ET1-1 | R-5 | 50500 | CGM-1 | +108 | −19 | B |
| Example 6 | A-6 | HT-1 | ET1-1 | R-6 | 51000 | CGM-1 | +105 | −18 | B |
| Example 7 | A-7 | HT-1 | ET1-1 | R-7 | 50000 | CGM-1 | +110 | −16 | A |
| Example 8 | A-8 | HT-1 | ET1-1 | R-8 | 51000 | CGM-1 | +104 | −17 | B |
| Example 9 | A-9 | HT-2 | ET1-1 | R-2 | 50150 | CGM-1 | +110 | −19 | B |
| Example 10 | A-10 | HT-3 | ET1-1 | R-2 | 50150 | CGM-1 | +107 | −16 | A |
| Example 11 | A-11 | HT-4 | ET1-1 | R-2 | 50150 | CGM-1 | +106 | −16 | A |
| Example 12 | A-12 | HT-5 | ET1-1 | R-2 | 50150 | CGM-1 | +111 | −18 | A |
| Example 13 | A-13 | HT-6 | ET1-1 | R-2 | 50150 | CGM-1 | +99 | −11 | A |
| Example 14 | A-14 | HT-7 | ET1-1 | R-2 | 50150 | CGM-1 | +98 | −10 | A |
| Example 15 | A-15 | HT-1 | ET2-1 | R-2 | 50150 | CGM-1 | +110 | −14 | A |
| Example 16 | A-16 | HT-1 | ET3-1 | R-2 | 50150 | CGM-1 | +103 | −19 | B |
| Example 17 | A-17 | HT-1 | ET4-1 | R-2 | 50150 | CGM-1 | +105 | −15 | A |
| Example 18 | A-18 | HT-1 | ET5-1 | R-2 | 50150 | CGM-1 | +96 | −9 | A |
| Example 19 | A-19 | HT-1 | ET1-1 | R-2 | 50150 | CGM-2 | +89 | −20 | A |

TABLE 2

| | Photosensitive member | Hole transport material Type | Electron transport material Type | Binder resin Type | Binder resin Molecular weight | Charge generating material Type | Sensitivity characteristics Post-exposure potential $V_L$ (V) | Transfer memory potential ΔVtc (V) | Image evaluation |
|---|---|---|---|---|---|---|---|---|---|
| Example 20 | A-20 | HT-1 | ET1-1 | R-9 | 50000 | CGM-1 | +105 | −15 | A |
| Example 21 | A-21 | HT-1 | ET1-1 | R-10 | 50500 | CGM-1 | +96 | −9 | A |
| Example 22 | A-22 | HT-1 | ET1-1 | R-11 | 52000 | CGM-1 | +89 | −20 | A |
| Comparative Example 1 | B-1 | HT-8 | ET1-1 | R-2 | 50150 | CGM-1 | +110 | −40 | D |
| Comparative Example 2 | B-2 | HT-9 | ET1-1 | R-2 | 50150 | CGM-1 | +112 | −55 | D |
| Comparative Example 3 | B-3 | HT-1 | ET6-1 | R-2 | 50150 | CGM-1 | +133 | −48 | D |
| Comparative Example 4 | B-4 | HT-1 | ET7-1 | R-2 | 50150 | CGM-1 | +129 | −42 | D |
| Comparative Example 5 | B-5 | HT-1 | ET8-1 | R-2 | 50150 | CGM-1 | +135 | −54 | D |
| Comparative Example 6 | B-6 | HT-1 | ET1-1 | R-A | 50000 | CGM-1 | +113 | −65 | D |
| Comparative Example 7 | B-7 | HT-1 | ET1-1 | R-B | 51000 | CGM-1 | +115 | −66 | D |
| Comparative Example 8 | B-8 | HT-1 | ET1-1 | R-C | 50500 | CGM-1 | +116 | −55 | D |
| Comparative Example 9 | B-9 | HT-1 | ET1-1 | R-D | 51000 | CGM-1 | +112 | −46 | D |
| Comparative Example 10 | B-10 | HT-1 | ET1-1 | R-E | 51000 | CGM-1 | +111 | −43 | D |
| Comparative Example 11 | B-11 | HT-1 | ET1-1 | R-F | 50500 | CGM-1 | +110 | −60 | D |

As shown in Tables 1 and 2, the photosensitive members (A-1) to (A-22) each included a single-layer photosensitive layer as a photosensitive layer. The photosensitive layer contained a charge generating material, a hole transport material, an electron transport material, and a binder resin. The hole transport material was any one of the triphenylamine derivatives (HT-1) to (HT-7). Each of the triphenylamine derivatives (HT-1) to (HT-7) is represented by general formula (HT). The electron transport material was any one of the electron transport materials (ET-1) to (ET-5). The electron transport materials (ET-1) to (ET-5) are represented by general formulas (ET1) to (ET5), respectively. The binder resin was any of the polyarylate resins (R-1) to (R-11). Each of the polyarylate resins (R-1) to (R-11) is represented by general formula (1). As shown in Tables 1 and 2, the photosensitive members (A-1) to (A-22) had a transfer memory potential of at least −20V and no greater than −9V to be evaluated as A (Very good) or B (Good) as results of the image evaluation.

As shown in Table 2, the photosensitive members (B-1) to (B-11) each included a single-layer photosensitive layer as a photosensitive layer. The photosensitive layer contained a charge generating material, a hole transport material, an electron transport material, and a binder resin. Specifically, the photosensitive layers of the photosensitive members (B-1) and (B-2) contained the hole transport materials (HT-8) and (HT-9), respectively. The hole transport materials (HT-8) and (HT-9) were not the triphenylamine derivative represented by general formula (HT). The photosensitive layers of the photosensitive members (B-3) to (B-5) contained any one of the electron transport materials (ET-6) to (ET-8). The electron transport materials (ET-6) to (ET-8) are not represented by any of general formulas (ET1) to (ET5). The photosensitive layers of the photosensitive members (B-6) to (B-11) contained any one of the binder resins (R-A) to (R-F). The binder resins (R-A) to (R-F) are not the polyarylate resin represented by general formula (1). As shown in Table 2, the photosensitive members (B-1) to (B-11) had a transfer memory potential of at least −66V and no greater than −40V to be evaluated as D (Poor) as results of the image evaluation.

As evident from Tables 1 and 2, the photosensitive members according to the first embodiment (photosensitive members (A-1) to (A-22)) had a smaller absolute value of the transfer memory potential than the photosensitive members (B-1) to (B-11). The results of the image evaluation were excellent. It is therefore clear that occurrence of transfer memory is inhibited through the photosensitive member according to the present invention. Furthermore, the image forming apparatus according to the second embodiment (image forming apparatus including any one of the photosensitive members (A-1) to (A-22)) was better in the results of the image evaluation than an image forming apparatus including any one of the photosensitive members (B-1) to (B-11). Consequently, it is clear that occurrence of an image defect is inhibited through the image forming apparatus according to the present invention.

As shown in Table 1, the photosensitive layers of the photosensitive members (A-13) and (A-14) contained the hole transport materials (HT-6) and (HT-7), respectively. Each of the triphenylamine derivatives (HT-6) and (HT-7) as a hole transport material is a triphenylamine derivative represented by general formula (HT). In general formula (HT), $R^1$ represents an alkyl group having a carbon number of at least 1 and no greater than 4 and k represents 2. Also, each of the triphenylamine derivatives (HT-6) and (HT-7) as a hole transport material is a triphenylamine derivative represented by general formula (HT). In general formula (HT), m1 and m2 represent 3. As shown in Table 1, the post-exposure potentials of the photosensitive members (A-13) and (A-14) were +99 V and +98 V, respectively, and the transfer memory potential thereof were −11 V and −10 V, respectively.

As shown in Table 1, the photosensitive layers of the photosensitive members (A-1) and (A-9) to (A-12) contained any one of the triphenylamine derivative (HT-1) to (HT-5) as a hole transport material. The triphenylamine derivatives (HT-1) to (HT-5) are triphenylamine derivatives represented by general formula (HT). However, with respect to the triphenylamine derivatives (HT-1) to (HT-5), it is not true in general formula (HT) that $R^1$ represents an alkyl group having a carbon number of at least 1 and no greater than 4 and k represents 2. Also, the triphenylamine derivatives (HT-1) to (HT-5) are triphenylamine derivatives represented by general formula (HT). However, with respect to the triphenylamine derivatives (HT-1) to (HT-5), it is not true in general formula (HT) that both m1 and m2 represent 3. As shown in Table 1, the post-exposure potentials of the photosensitive members (A-1) and (A-9) to (A-12) were at least +106 V and no greater than +111 V and the transfer memory voltage thereof were at least −19 V and no greater than −16 V.

As evident from Table 1, the photosensitive members (A-13) and (A-14) had a smaller absolute value of the transfer memory potential and a smaller post-exposure potential than the photosensitive members (A-1) and (A-9) to (A-12). It is clear that when $R^1$ represents an alkyl group having a carbon number of at least 1 and no greater than 4 and k represents 2 in general formula (HT) of the triphenylamine derivative or when m1 and m2 represent 2 in general formula (HT) thereof, occurrence of transfer memory is more inhibited and more excellent sensitivity characteristics are achieved through a photosensitive layer containing a triphenylamine derivative represented by general formula (HT) as a hole transport material than through a photosensitive member containing another triphenylamine derivative.

As shown in Table 1, the photosensitive layer of the photosensitive member (A-18) contained the electron transport material (ET5-1) represented by general formula (ET5). The transfer memory potential was −9 V, and the post-exposure potential was +96 V.

As shown in Table 1, the photosensitive layers of the photosensitive members (A-1) and (A-15) to (A-17) contained any of the electron transport materials (ET1-1) to (ET4-1). The electron transport materials (ET1-1) to (ET4-1) are represented by general formulas (ET1) to (ET4), respectively. The transfer memory potentials were at least −19 V and no greater than −14 V, and the pot-exposure potentials were at least +103 V and no greater than +110 V.

As evident from Table 1, the photosensitive member (A-18) had a smaller absolute value of the transfer memory potential and a smaller post-exposure potential than the photosensitive members (A-1) and (A-15) to (A-17). It is clear that occurrence of transfer memory is more inhibited and more excellent sensitivity characteristics are achieved through a photosensitive member including a photosensitive layer containing the electron transport material represented by general formula (ET5) than a photosensitive member not containing the electron transport material represented by general formula (ET5).

INDUSTRIAL APPLICABILITY

The electrophotographic photosensitive member according to the present invention is applicable to image forming apparatuses such as multifunction peripherals.

The invention claimed is:

1. An electrophotographic photosensitive member comprising a conductive substrate and a photosensitive layer, wherein the photosensitive layer is a single-layer photosensitive layer, the photosensitive layer contains a charge generating material, a hole transport material, an electron transport material, and a binder resin, the hole transport material includes a triphenylamine derivative, the triphenylamine derivative is represented by a general formula (HT) shown below, the electron transport material includes a compound represented by a general formula (ET1), a general formula (ET2), a general formula (ET3), a general formula (ET4), or a general formula (ET5) shown below, the binder resin includes only a polyarylate resin, and the polyarylate resin is represented by a general formula (1) shown below, (1)

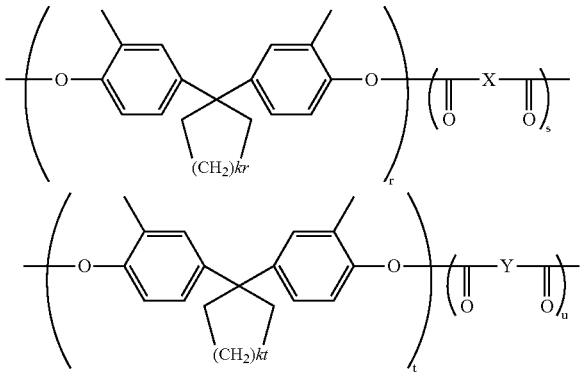

in the general formula (1), r and s represent an integer of at least 0 and no greater than 49, t and u represent an integer of at least 1 and no greater than 50, r+s+t+u=100, r+t=s+u, r and t may be the same as or different from each other, s and u may be the same as or different from each other, kr represents 3, kt represents 3, X and Y each represent, independently of one another, a divalent group represented by a chemical formula (2A), a chemical formula (2C), a chemical formula (2D), a chemical formula (2E), a chemical formula (2F), or a chemical formula (2G) shown below, and X and Y differ from each other, (2A)

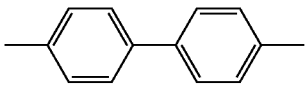

(2C)

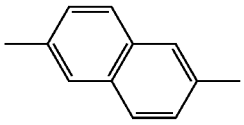

-continued (2D)

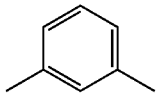

(2E)

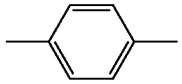

(2F)

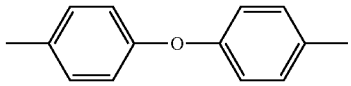

(2G)

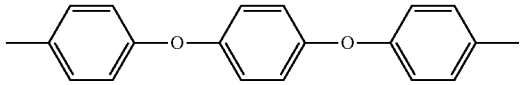

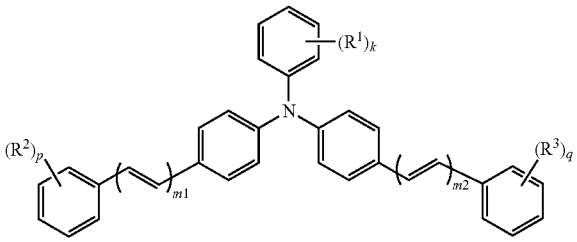

(HT)

in the general formula (HT), $R^1$, $R^2$, and $R^3$ each represent, independently of one another, an alkyl group having a carbon number of at least 1 and no greater than 4 or an alkoxy group having a carbon number of at least 1 and no greater than 4, k, p, and q each represent, independently of one another, an integer of at least 0 and no greater than 5, m1 and m2 each represent, independently of one another, an integer of at least 1 and no greater than 3, when k represents an integer of at least 2, plural chemical groups represented by $R^1$ may be the same as or different from one another, when p represents an integer of at least 2, plural chemical groups represented by $R^2$ may be the same as or different from one another, and when q represents an integer of at least 2, plural chemical groups represented by $R^3$ may be the same as or different from one another, (ET1)

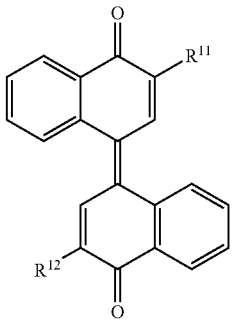

-continued (ET2)

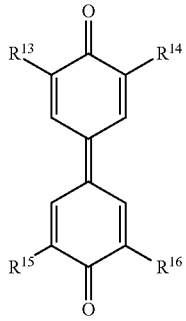

(ET3)

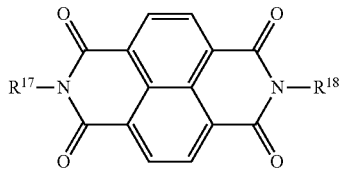

(ET4)

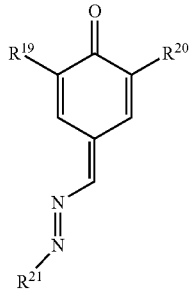

(ET5)

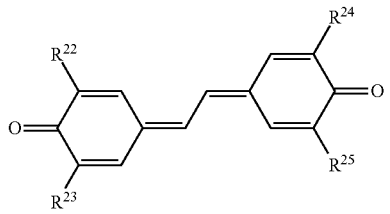

in the general formula (ET1), $R^{11}$ and $R^{12}$ represent an alkyl group having a carbon number of at least 1 and no greater than 6, in the general formula (ET2), $R^{13}$, $R^{14}$, $R^{15}$, and $R^{16}$ represent an alkyl group having a carbon number of at least 1 and no greater than 6, in the general formula (ET3), $R^{17}$ and $R^{18}$ each represent, independently of one another, an aryl group having a carbon number of at least 6 and no greater than 14 and optionally having one or more alkyl groups having a carbon number of at least 1 and no greater than 3, in the general formula (ET4), $R^{19}$ and $R^{20}$ represent an alkyl group having a carbon number of at least 1 and no greater than 6, and $R^{21}$ represents an aryl group having a carbon number of at least 6 and no greater than 14 and optionally having one or more halogen atoms, and in the general formula (ET5), $R^{22}$, $R^{23}$, $R^{24}$, and $R^{25}$ represent an alkyl group having a carbon number of at least 1 and no greater than 6.

2. The electrophotographic photosensitive member according to claim 1, wherein in the general formula (1), s/(s+u) is at least 0.30 and no greater than 0.70.

3. The electrophotographic photosensitive member according to claim 1, wherein the polyarylate resin is represented by a chemical formula (R-1), a chemical formula (R-2), a chemical formula (R-3), a chemical formula (R-4), a chemical formula (R-5), a chemical formula (R-6), a chemical formula (R-7), a chemical formula (R-8), a chemical formula (R-9), a chemical formula (R-10), or a chemical formula (R-11) shown below, (R-1)

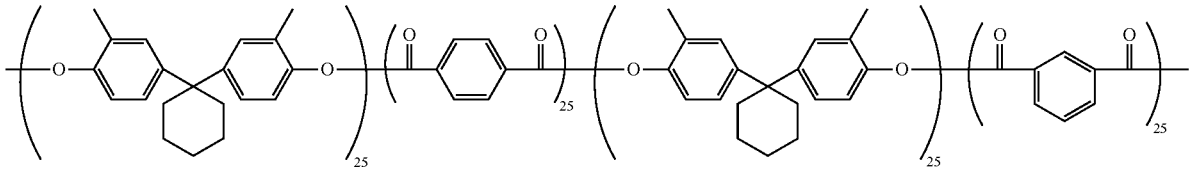

(R-2)

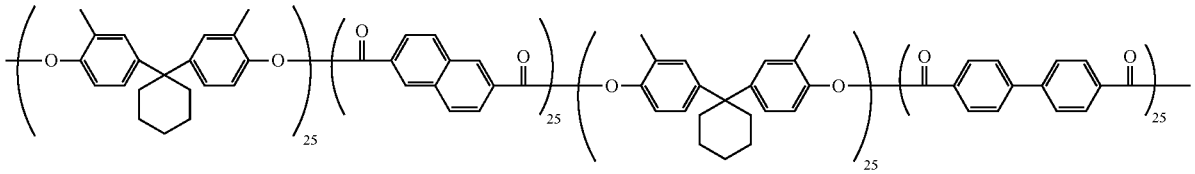

-continued
(R-3)
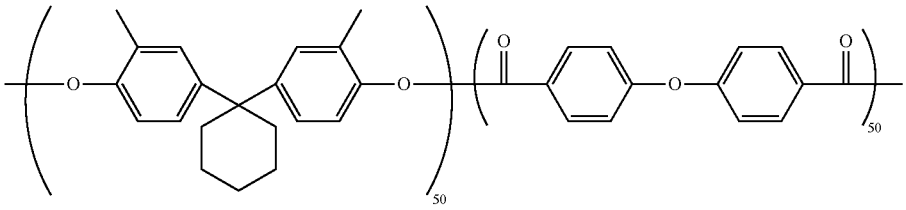
(R-4)
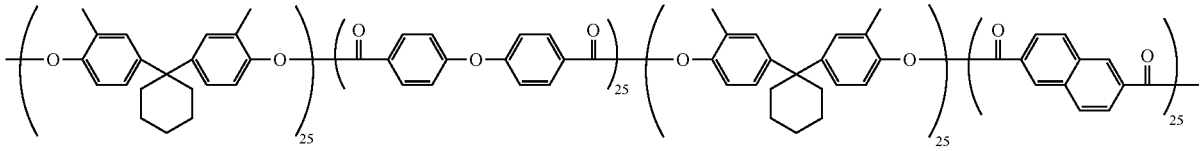
(R-5)
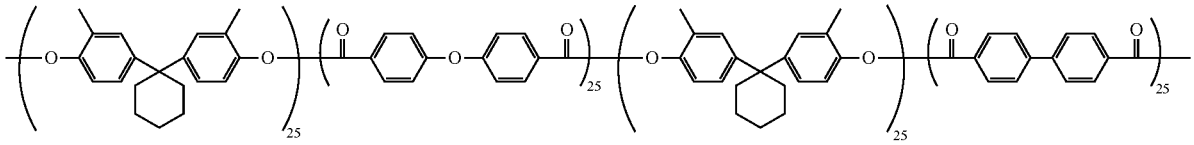
(R-6)
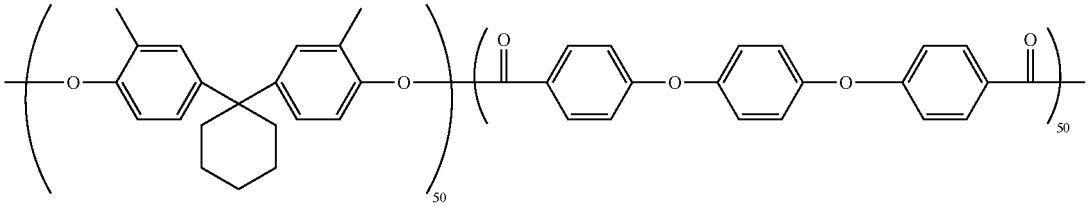
(R-7)
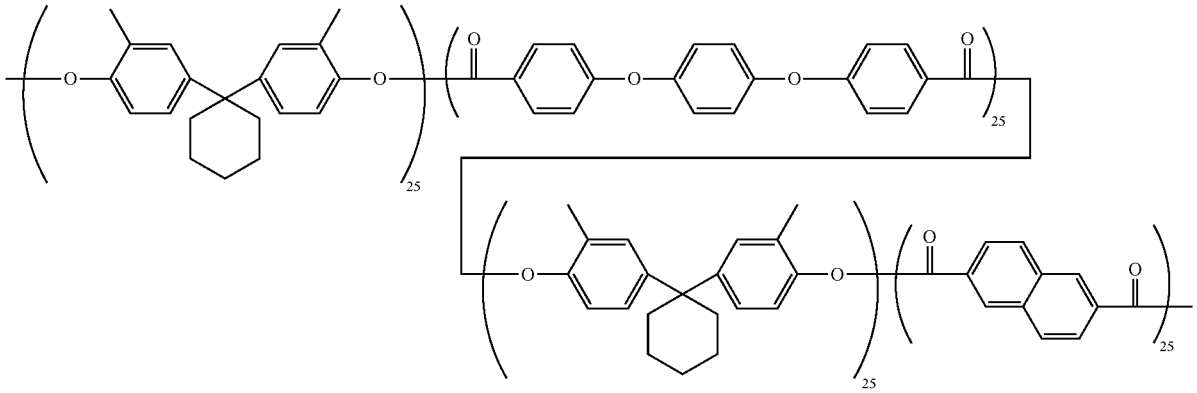
(R-8)
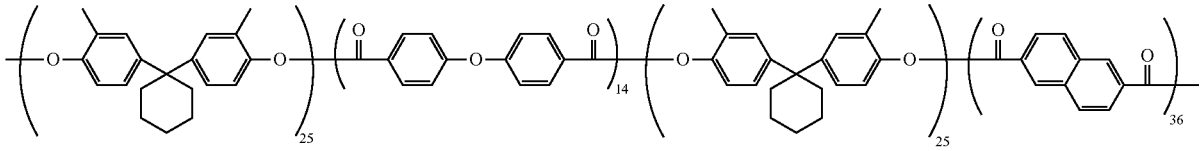
(R-9)
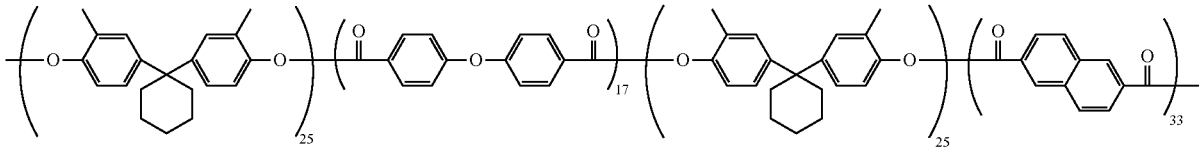

-continued (R-10)

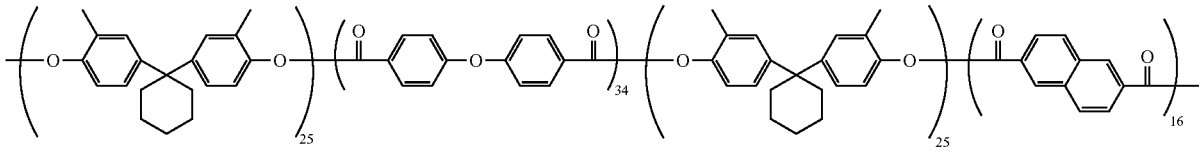

(R-11)

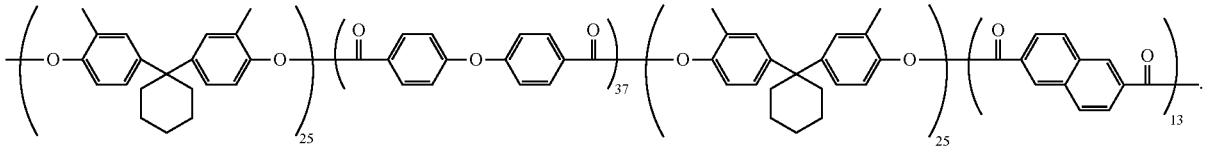

4. The electrophotographic photosensitive member according to claim 1, wherein in the general formula (HT), $R^1$ represents a chemical group selected from the group consisting of alkoxy groups having a carbon number of at least 1 and no greater than 4 and alkyl groups having a carbon number of at least 1 and no greater than 4, k represents 1 or 2, when k represents 2, two chemical groups $R^1$ may be the same as or different from each other, p and q represent 0, and m1 and m2 represent 2 or 3.

5. The electrophotographic photosensitive member according to claim 1, wherein in the general formula (HT), $R^1$ represents an alkyl group having a carbon number of at least 1 and no greater than 4, and k represents 2.

6. The electrophotographic photosensitive member according to claim 1, wherein in the general formula (HT), m1 and m2 represent 3.

7. The electrophotographic photosensitive member according to claim 1, wherein the triphenylamine derivative is represented by a chemical formula (HT-1), a chemical formula (HT-2), a chemical formula (HT-3), a chemical formula (HT-4), a chemical formula (HT-5), a chemical formula (HT-6), or a chemical formula (HT-7) shown below, (HT-1)

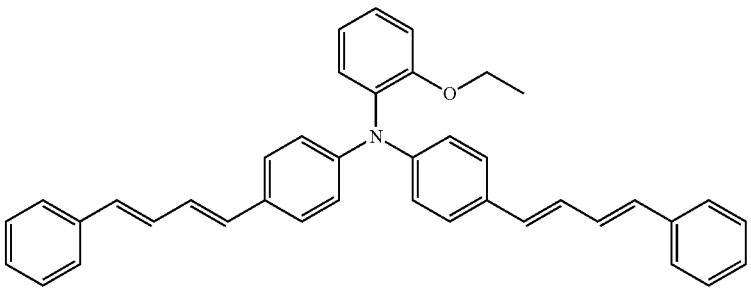

(HT-2)

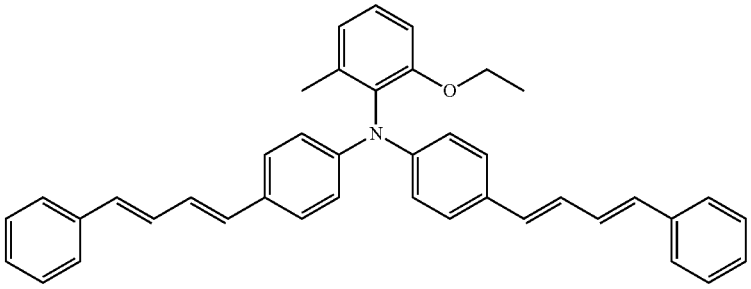

-continued
(HT-3)
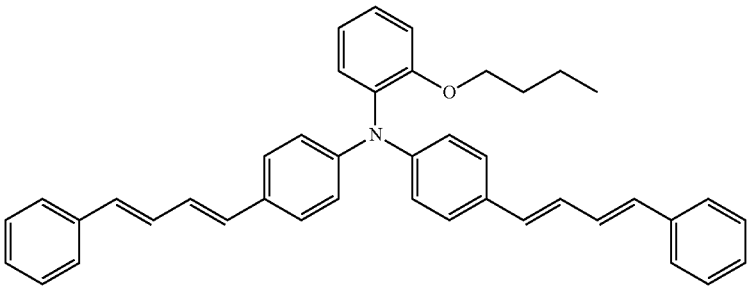
(HT-4)
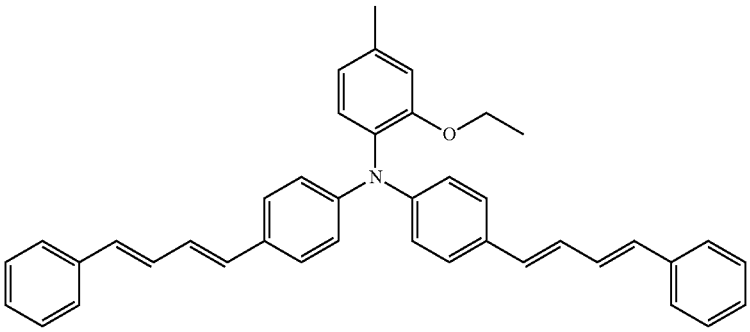
(HT-5)
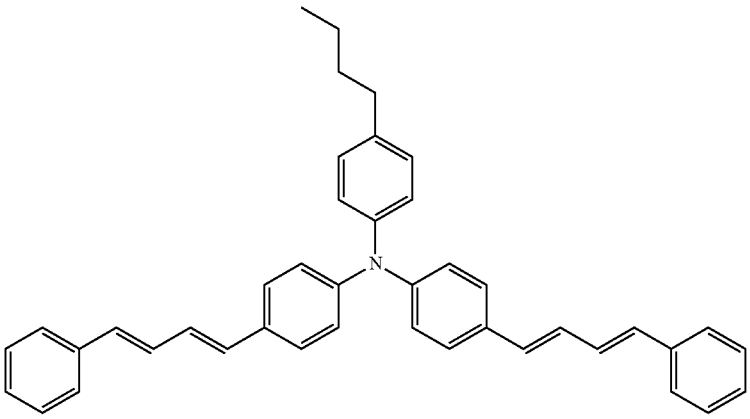
(HT-6)
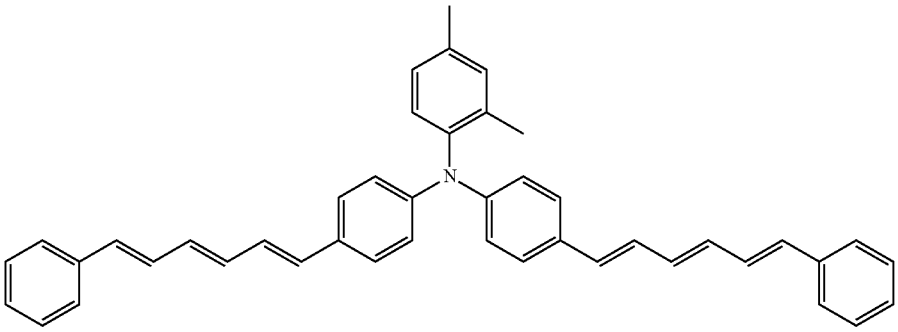

-continued (HT-7)

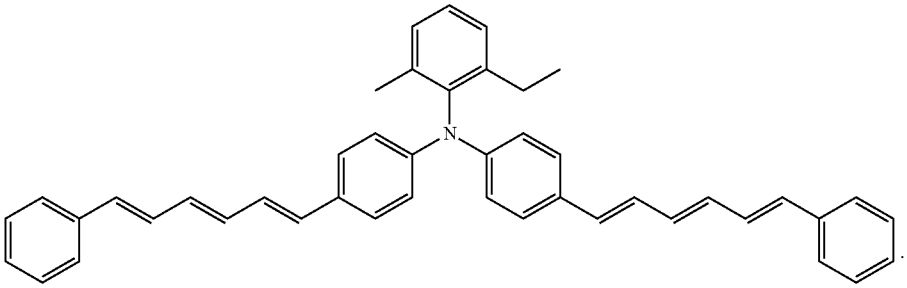

8. The electrophotographic photosensitive member according to claim 1, wherein in the general formula (ET1), $R^{11}$ and $R^{12}$ represent an alkyl group having a carbon number of at least 1 and no greater than 5, in the general formula (ET2), $R^{13}$, $R^{14}$, $R^{15}$, and $R^{16}$ represent an alkyl group having a carbon number of at least 1 and no greater than 4, in the general formula (ET3), $R^{17}$ and $R^{18}$ represent a phenyl group having plural alkyl groups having a carbon number of at least 1 and no greater than 2, in the general formula (ET4), $R^{19}$ and $R^{20}$ represent an alkyl group having a carbon number of at least 1 and no greater than 4, and $R^{21}$ represents an phenyl group having a halogen atom, and in the general formula (ET5), $R^{22}$, $R^{23}$, $R^{24}$, and $R^{25}$ represent an alkyl group having a carbon number of at least 1 and no greater than 4.

9. The electrophotographic photosensitive member according to claim 1, wherein the electron transport material is the compound represented by the general formula (ET5).

10. The electrophotographic photosensitive member according to claim 1, wherein the electron transport material is represented by a chemical formula (ET1-1), a chemical formula (ET2-1), a chemical formula (ET3-1), a chemical formula (ET4-1), or a chemical formula (ET5-1) shown below, (ET1-1)

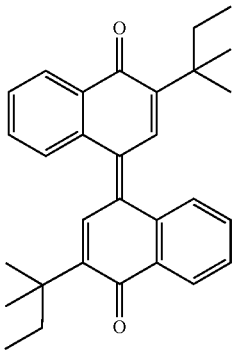

-continued (ET2-1)

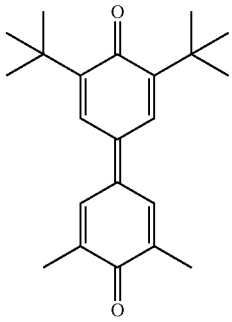

(ET3-1)

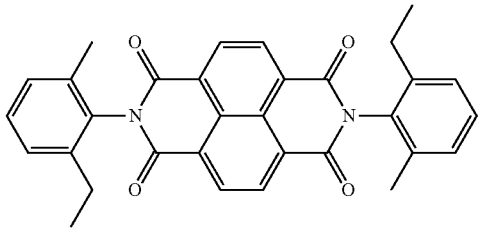

(ET4-1)

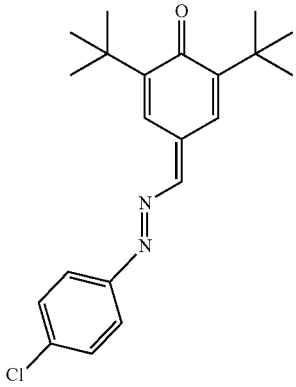

(ET5-1)

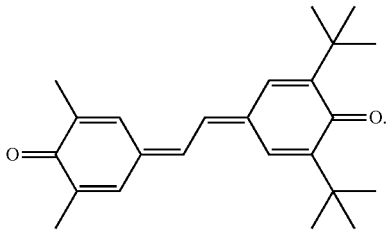

11. The electrophotographic photosensitive member according to claim 1, wherein the charge generating material is an X-form metal-free phthalocyanine pigment or a Y-form titanyl phthalocyanine pigment.

12. A process cartridge comprising the electrophotographic photosensitive member according to claim 1.

13. An image forming apparatus, comprising:

an image bearing member;

a charger configured to charge a surface of the image bearing member;

a light exposure section configured to expose the surface of the image bearing member in a charged state to light to form an electrostatic latent image on the surface of the image bearing member;

a developing section configured to develop the electrostatic latent image into a toner image; and a transfer section configured to transfer the toner image from the image bearing member to a recording medium, wherein the image bearing member is the electrophotographic photosensitive member according to claim 1, the charger has a positive charging polarity, and the transfer section transfers the toner image to the recording medium in a state in which the surface of the image bearing member is in contact with the recording medium.

14. The image forming apparatus according to claim 13, wherein the charger charges the surface of the image bearing member by applying direct current voltage while in contact with the surface of the image bearing member.

15. The electrophotographic photosensitive member according to claim 1, wherein in the general formula (HT), m1 and m2 each represents 3, and the electron transport material includes a compound represented by the general formula (ET1).

16. The electrophotographic photosensitive member according to claim 1, wherein the triphenylamine derivative is represented by a chemical formula (HT-6) or a chemical formula (HT-7) shown below, and the electron transport material is represented by a chemical formula (ET1-1) shown below:

(HT-6)

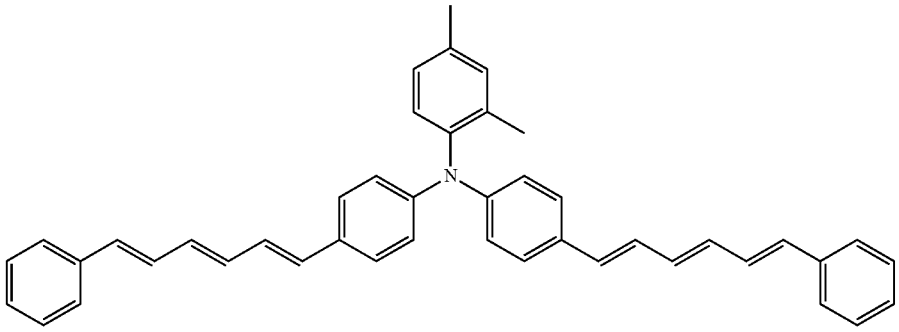

(HT-7)

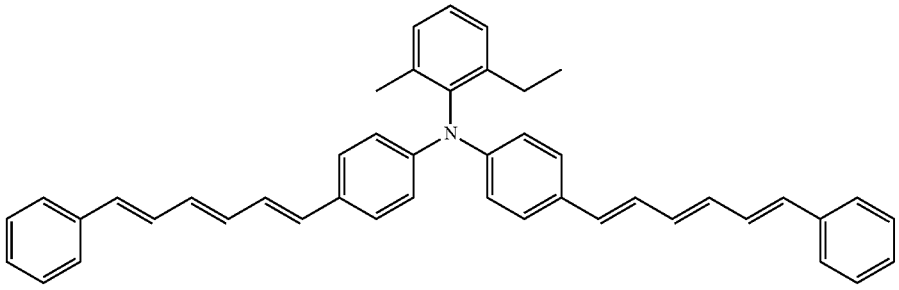

(ET1-1)

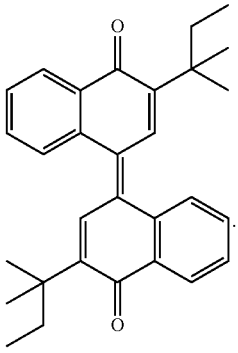

* * * * *